US011052630B2

(12) United States Patent
Oiwa et al.

(10) Patent No.: US 11,052,630 B2
(45) Date of Patent: Jul. 6, 2021

(54) SHEET PROCESSOR AND SHEET PROCESSING APPARATUS

(71) Applicant: DUPLO SEIKO CORPORATION, Kinokawa (JP)

(72) Inventors: Hideki Oiwa, Kinokawa (JP); Yasuhiro Tanaka, Kinokawa (JP); Masayasu Matsumoto, Kinokawa (JP); Takuya Tashiro, Kinokawa (JP)

(73) Assignee: DUPLO SEIKO CORPORATION, Kinokawa (JP)

( * ) Notice: Subject to any disclaimer, the term of this patent is extended or adjusted under 35 U.S.C. 154(b) by 245 days.

(21) Appl. No.: 15/985,770

(22) Filed: May 22, 2018

(65) Prior Publication Data

US 2018/0339483 A1 Nov. 29, 2018

(30) Foreign Application Priority Data

May 24, 2017 (JP) ..... JP2017-103020

(51) Int. Cl.
*B65H 43/00* (2006.01)
*B65H 37/06* (2006.01)
(Continued)

(52) U.S. Cl.
CPC ..... *B31F 1/08* (2013.01); *B26D 5/007* (2013.01); *B26D 7/2614* (2013.01);
(Continued)

(58) Field of Classification Search
CPC ..... B26D 1/065; B26D 1/045; B26D 1/085; B26D 1/105; B26D 3/085; B26D 7/2614;
(Continued)

(56) References Cited

U.S. PATENT DOCUMENTS 4,694,722 A * 9/1987 Collier ..... B26D 3/08 225/2
2012/0115702 A1* 5/2012 Ishikawa ..... G03G 15/6582 493/405
(Continued)

FOREIGN PATENT DOCUMENTS

DE 102008060073 6/2010
DE 2610201 7/2013
(Continued)

OTHER PUBLICATIONS

"Downward"—definition by Merriam-Webster Online Dictionary, retrieved from URL https://www.merriam-webster.com/dictionary/downward on Nov. 19, 2020 (Year: 2020).*
(Continued)

*Primary Examiner* — Valentin Neacsu
(74) *Attorney, Agent, or Firm* — Buchanan Ingersoll & Rooney PC

(57) ABSTRACT

A sheet processor subjecting a sheet having been conveyed forward to processing along a direction perpendicular to a conveyance direction of the sheet, includes: a processing unit performing the processing; and a receiving unit receiving the processing unit therein in a state capable of perfecting the processing on the sheet, and the processing unit includes a first processing tool 4A and a second processing tool 4B disposed to vertically oppose each other with a conveyance surface of the sheet disposed therebetween, and the receiving unit includes at least one receiver that removably receives the first processing tool 4A and the second processing tool 4B in the state capable of performing the processing on the sheet, with arbitrarily selected one of the first processing tool 4A and the second processing tool 4B disposed above the conveyance surface, and with arbitrarily selected another of the first processing tool 4A and the
(Continued)

second processing tool 4B disposed below the conveyance surface.

18 Claims, 32 Drawing Sheets

(51) Int. Cl.

| | |
|---|---|
| ***B31F 1/08*** | (2006.01) |
| ***B26D 5/00*** | (2006.01) |
| ***B31B 50/14*** | (2017.01) |
| ***B31B 50/25*** | (2017.01) |
| ***B26D 7/26*** | (2006.01) |
| *B31B 50/04* | (2017.01) |
| *B26D 1/06* | (2006.01) |
| *B31B 50/06* | (2017.01) |
| *B26D 1/00* | (2006.01) |
| *B31B 50/00* | (2017.01) |

(52) U.S. Cl.
CPC ..... *B31B 50/142* (2017.08); *B31B 50/252* (2017.08); *B65H 37/06* (2013.01); *B65H 43/00* (2013.01); *B26D 1/065* (2013.01); *B26D 2001/0066* (2013.01); *B31B 50/006* (2017.08); *B31B 50/042* (2017.08); *B31B 50/06* (2017.08)

(58) Field of Classification Search
CPC ..... B31B 50/006; B31B 50/042; B31B 50/06; B31B 50/142; B31B 50/252; B31B 50/592; B26F 2001/4454
USPC ..... 493/30, 354, 59, 62, 61, 74, 160, 355; 83/879, 862, 864, 884, 883
See application file for complete search history.

(56) References Cited

U.S. PATENT DOCUMENTS

| | | | | |
|---|---|---|---|---|
| 2012/0157285 | A1* | 6/2012 | Aiba | B65H 45/18 493/405 |
| 2013/0165310 | A1* | 6/2013 | Barrer | B65H 45/30 493/468 |
| 2014/0196861 | A1* | 7/2014 | Ota | B65H 35/02 162/286 |
| 2016/0346945 | A1* | 12/2016 | Oiwa | B26D 9/00 |

FOREIGN PATENT DOCUMENTS

| | | | |
|---|---|---|---|
| JP | H11-179445 | A | 7/1999 |
| JP | 2002-011811 | A | 1/2002 |
| JP | 2015-174108 | A | 10/2015 |
| JP | 2016-221667 | | 12/2016 |

OTHER PUBLICATIONS

"Upward"—definition by Merriam-Webster Online Dictionary, retrieved from URL https://www.merriam-webster.com/dictionary/upward on Nov. 19, 2020 (Year: 202).*

Extended European Search Report issued in corresponding European Patent Application No. 18173533.3-1016, dated Nov. 20, 2018 (6 pages).

Notification of Reasons for Refusal issued in corresponding Japanese Patent Application No. 2017-103020, dated Mar. 23, 2021, with English Translation (8 pages).

* cited by examiner

4121
ON
OFF
521
411
4A6
413
4141
5A
4111
461
4642
4611
4641
4612
5B
463
ON
ON
4621
4622
582
4B6

4641
ON
ON
521
4B6
5A
4611
4111
OFF
ON
4141
582
4A6
5B

4121
ON
OFF
521
4A6
4111
4612
ON
ON
4642
582
4B6

4621
ON
ON
521
4B6
4612
4111
OFF
ON
4141
582
4A6

4121
OFF
ON
521
4113
4A4
461
4613
ON
OFF
4623
463
4B7

OFF
OFF
521
OFF
OFF
582

SHEET PROCESSOR AND SHEET PROCESSING APPARATUS

BACKGROUND OF THE INVENTION

Technical Field

The present invention relates to a sheet processor that subjects a having-been-conveyed sheet to processing along a direction perpendicular to a conveyance direction of the sheet, and a sheet processing apparatus including the sheet processor.

Background Art

A conventional sheet processor performs processing on a front surface of a having-been-conveyed sheet. Therefore, when the processing is desired to be performed on a back surface of the sheet, the sheet placed on a sheet feed table is turned over.

PRIOR ART REFERENCE

Patent Documents

[Patent Document 1] JP 2016-221667 A

SUMMARY OF THE INVENTION

Problems to be Solved by the Invention

The sheet placed on the feed table is, however, in the form of a bundle, and hence is bulk and heavy. Therefore, it is not easy to turn over the sheet.

Besides, when a sheet is turned over to perform processing, the following problems occur:

(a) When a back surface of the sheet has print thereon, it is apprehended that a printed portion may be damaged by a conveyance guide or the like if the sheet is conveyed without changing the posture. Therefore, when the damage of a printed portion is desired to be prevented preferentially, it is necessary to turn the sheet over to convey the sheet with its back surface facing upward. In this case, however, when the front surface of the sheet facing downward is desired to be, for example, subjected to crease processing, the crease processing is compelled to perform from the back surface of the sheet facing upward. On the contrary, when the processing is to be performed on the front surface of the sheet facing upward, the damage of the printed portion on the back surface should be risked.

(b) In the case where a sheet has print on the back surface, when the front surface of the sheet is to be subjected to processing based on processing information of a bar code or the like while conveying the sheet without changing the posture, it is necessary to print the processing information also on the front surface of the sheet. In other words, the sheet needs to have print on both the surfaces. This increases, however, print cost.

An object of the present invention is to provide a sheet processor capable of performing processing also on a back surface of a sheet without turning the sheet over, and a sheet processing apparatus including the sheet processor.

Means for Solving the Problem

According to the present invention, a sheet processor subjecting a sheet having been conveyed forward to processing along a direction perpendicular to a conveyance direction of the sheet, includes: a processing unit performing the processing; and a receiving unit receiving the processing unit therein in a state capable of performing the processing on the sheet, and the processing unit includes a first processing tool and a second processing tool disposed to vertically oppose each other with a conveyance surface of the sheet disposed therebetween, and the receiving unit includes at least one receiver that removably receives the first processing tool and the second processing tool in the state capable of performing the processing on the sheet, with arbitrarily selected one of the first processing tool and the second processing tool disposed above the conveyance surface, and with arbitrarily selected another of the first processing tool and the second processing tool disposed below the conveyance surface.

Effect of the Invention

According to the present invention, processing can be performed on a front surface of a sheet with a first processing tool disposed above a conveyance surface of the sheet and with a second processing tool disposed below the conveyance surface of the sheet, and in addition, the processing can be performed on a back surface of the sheet with the second processing tool disposed above the conveyance surface of the sheet and with the first processing tool disposed below the conveyance surface of the sheet. Therefore, there is no need to turn the sheet over when the processing is performed not only on the front surface of the sheet but also on the back surface thereof. Accordingly, workability in the processing performed on the front and back surfaces of the sheet can be improved.

In addition, since arbitrary processing can be performed on the front surface or the back surface of a sheet without turning over the sheet in the present invention, the following effects can be exhibited:

(i) Arbitrary processing can be performed on the front surface or the back surface of a sheet during conveyance of the sheet with a surface having print thereon facing upward, and therefore, specification of a surface to be processed and damage prevention can be both realized.

(ii) Processing information can be printed on a surface of a sheet having print thereon, and hence the sheet need not have print on both surfaces. Accordingly, print cost can be lowered.

BRIEF DESCRIPTION OF THE DRAWINGS

FIGS. 23A to 23D are schematic transverse cross-sectional views illustrating processing aspects of a processing unit according to Modification 6.

DETAILED DESCRIPTION

A sheet processing apparatus including a sheet processor according to one embodiment of the present invention will now be described.

[Whole Structure]

Figure 1:
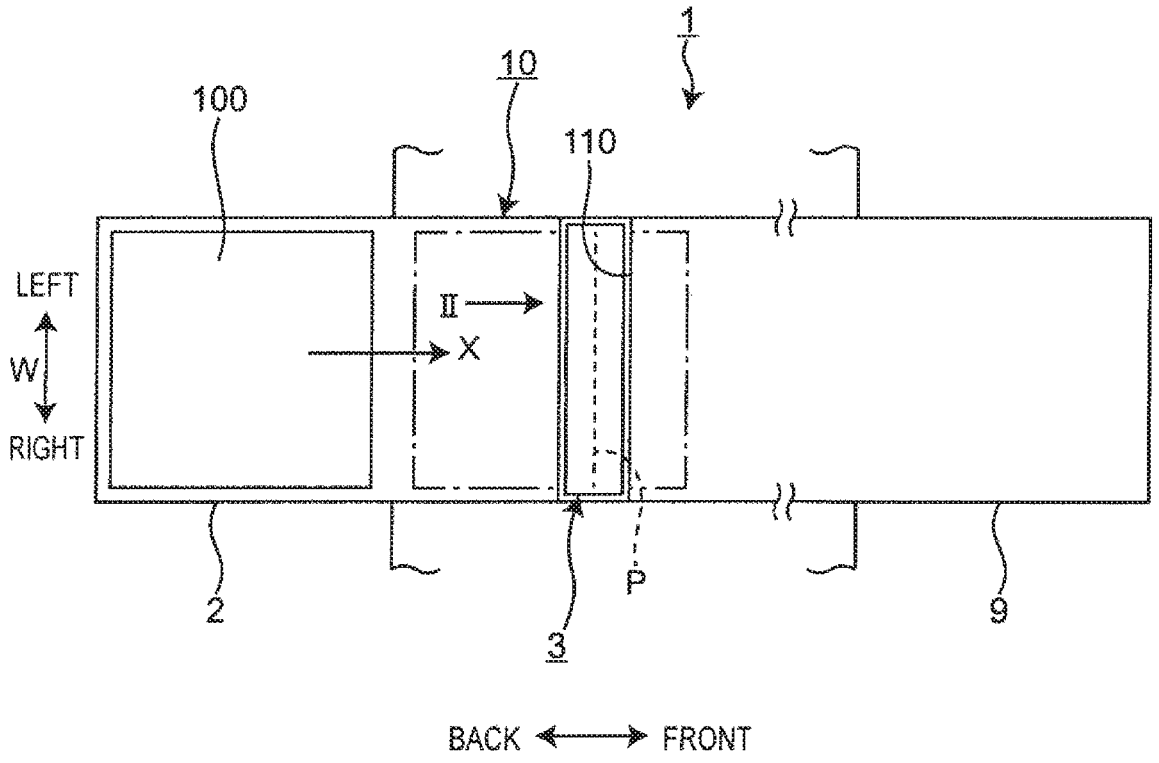
FIG. 1 is a schematic plan view illustrating a sheet processing apparatus including a sheet processor according to one embodiment of the present invention.

FIG. 1 is a schematic plan view illustrating a sheet processing apparatus including a sheet processor according to one embodiment of the present invention. The sheet processing apparatus 1 includes at least a sheet feeding unit 2, the sheet processor 3 and a sheet discharging unit 9. The sheet processing apparatus 1 is configured to process a sheet 100 with the sheet processor 3 while conveying the sheet 100 in a direction X and to discharge the resultant sheet to the sheet discharging unit 9. In the sheet processor 3, the conveyance of the sheet 100 is stopped in a processing position P, where the sheet 100 is subjected to processing. The sheet processor 3 is configured to perform the processing along a perpendicular direction (a widthwise direction W) to the conveyance direction X. The conveyance along the direction X (the conveyance direction) is performed by conveyance rollers (not shown) provided in appropriate positions on an upstream side and a downstream side in the conveyance direction of the sheet processor 3. In the following description, the term "front" refers to the downstream side in the conveyance direction, and the term "back" refers to the upstream side in the conveyance direction.

[Sheet Processor]

(Whole Structure)

Figure 2:
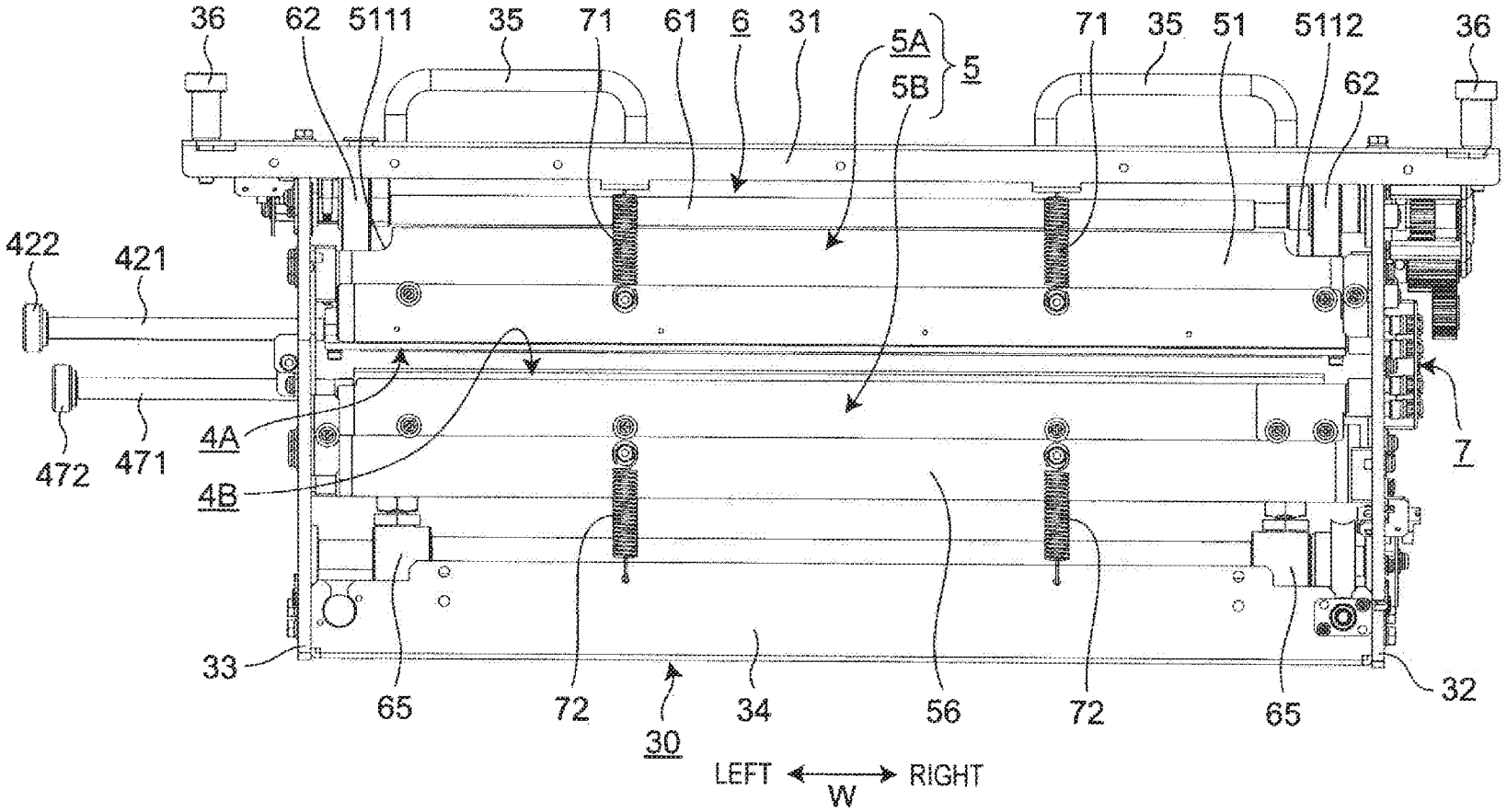
FIG. 2 is a view taken along arrow II of the sheet processor of FIG. 1.

FIG. 2 is a view taken along arrow II of the sheet processor 3 of FIG. 1. It is noted that the sheet processor 3 is illustrated with a surface cover and a sheet guide provided on the upstream side and the downstream side in the conveyance direction X removed so that an inside structure thereof can be easily grasped. The sheet processor 3 is configured to be provided, for use, to be removable upward within a receiving section 110 of a main body 10 of the sheet processing apparatus 1 as illustrated in FIG. 1.

In the sheet processor 3, a top plate 31, a right side plate 32 and a left side plate 33 pendant respectively from ends of the top plate 31, and a bottom frame 34 connecting lower ends of the both side plates 32 and 33 to each other together form an outer frame 30. On a top surface of the top plate 31, two handles 35 to be grasped in attaching the sheet processor 3 within the receiving section 110 are provided. Besides, one finger screw 36 is provided at each end in the widthwise direction of the top plate 31. The sheet processor 3 attached within the receiving section 110 is configured to be removably fixed on the main body 10 with the finger screws 36.

The sheet processor 3 includes a processing unit 4 performing processing, and a receiving unit 5 receiving the processing unit 4 in a state where the processing can be performed on the sheet 100.

(Processing Unit)

Figure 3:
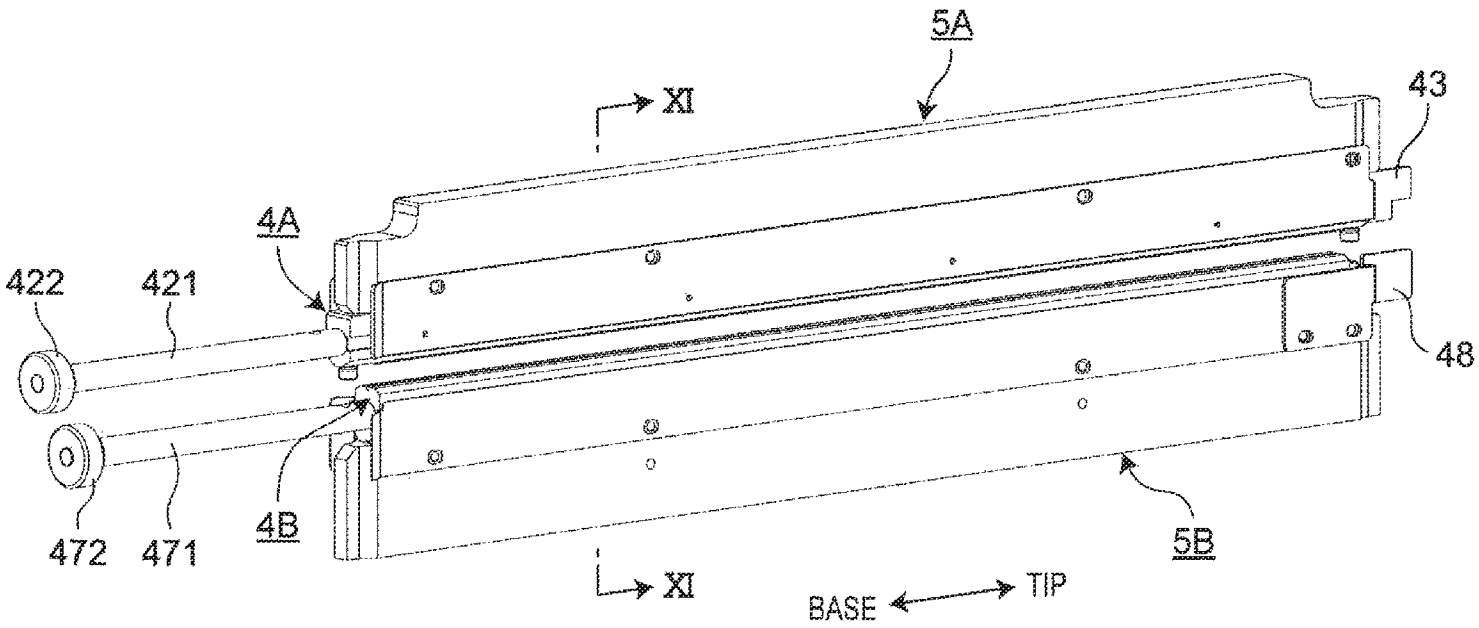
FIG. 3 is a top perspective view illustrating a processing unit and a receiving unit receiving the processing unit therein.

FIG. 3 is a top perspective view illustrating the processing unit 4 and the receiving unit 5 receiving the processing unit 4 therein. The processing unit 4 includes a first processing tool 4A and a second processing tool 4B.

Figure 4:
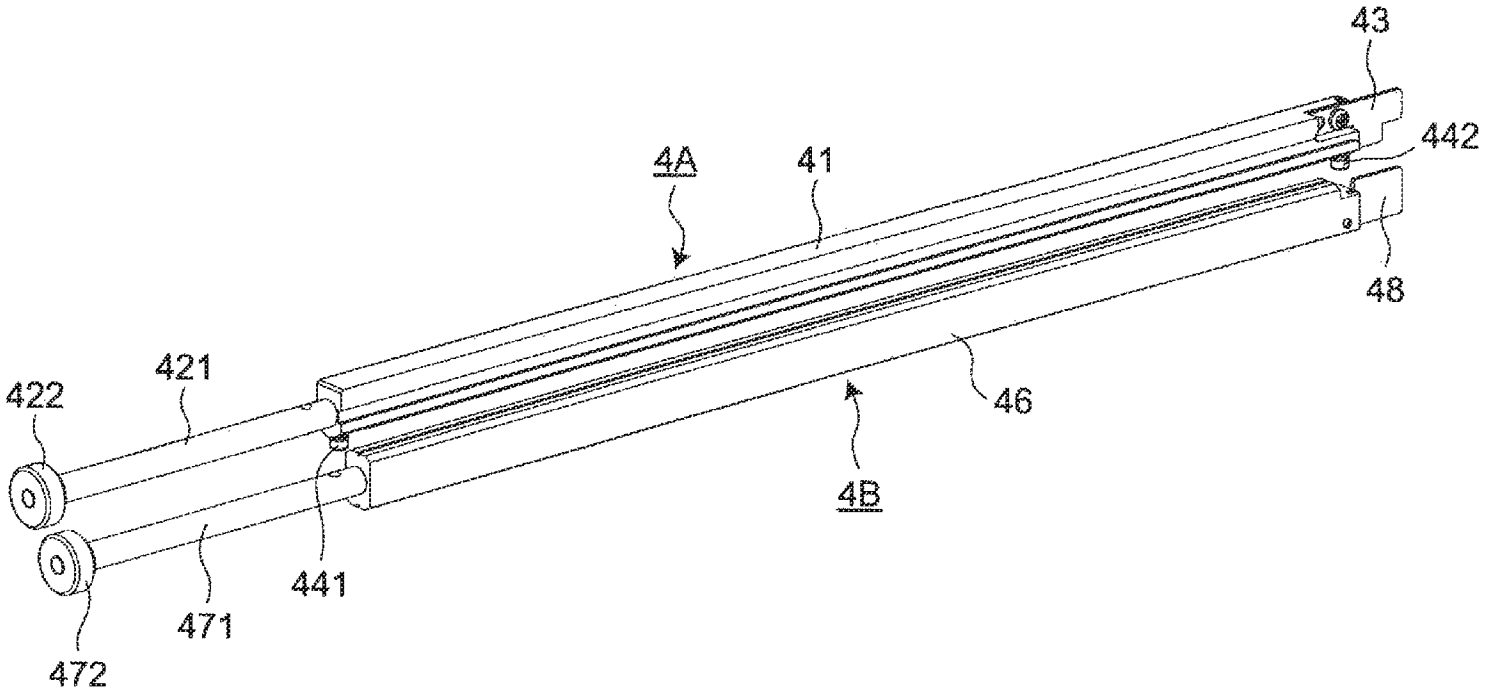
FIG. 4 is a top perspective view of a first processing tool and a second processing tool.
Figure 5:
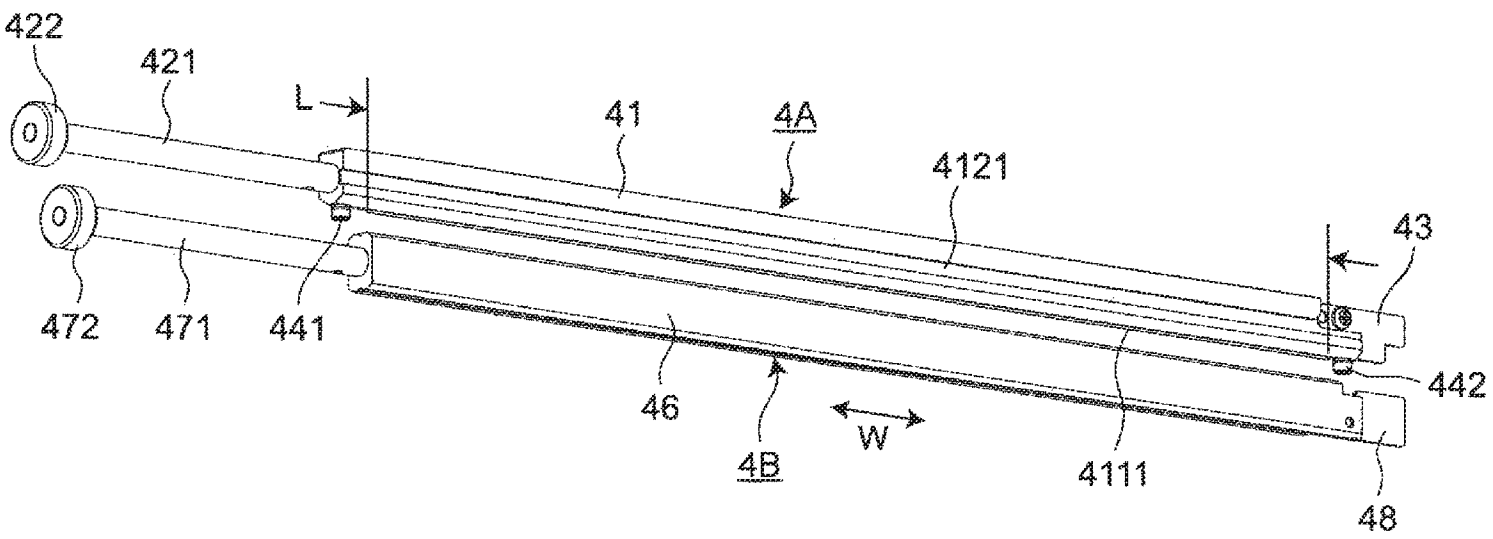
FIG. 5 is a bottom perspective view of the first processing tool and the second processing tool.

FIGS. 4 and 5 are respectively a top perspective view and a bottom perspective view of the first processing tool 4A and the second processing tool 4B. The first processing tool 4A includes a first processing body 41, a hold 421, a handle 422, a first identification section 43, and interfering members 441 and 442. The second processing tool 48 includes a second processing body 46, a hold 471, a handle 472, and a second identification section 48.

Figure 6:
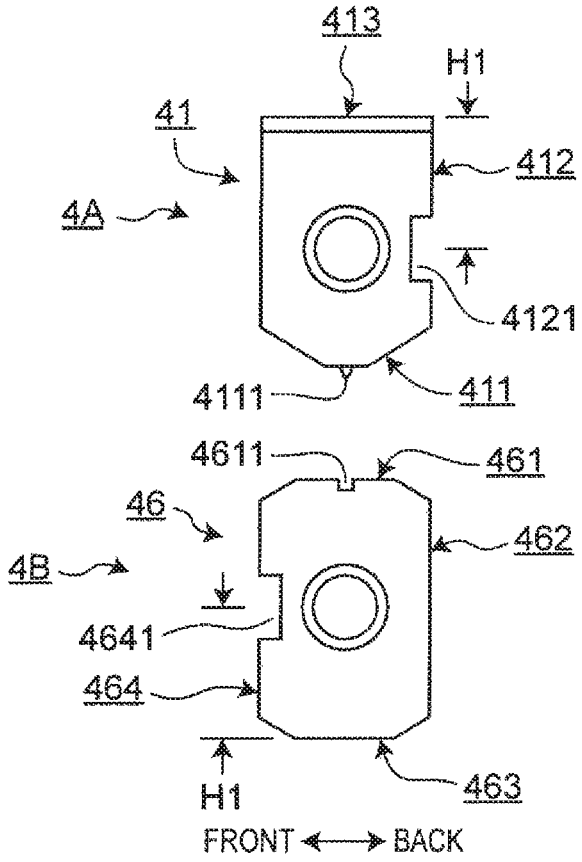
FIG. 6 is a transverse cross-sectional view of the first processing tool and the second processing tool.

FIG. 6 is a transverse cross-sectional view of the first processing tool 4A and the second processing tool 4B. The first processing body 41 of the first processing tool 4A is a long and narrow rod-shaped member having a substantially rectangular transverse cross section, and has a processing surface 411 on a lower surface as illustrated in FIG. 6. The processing surface 411 protrudes to have a substantially triangular transverse cross section, and has a creasing convex blade 4111 in a region L (see FIG. 5) having a prescribed length in a longitudinal direction (widthwise direction W) in a protruding tip portion. In other words, the first processing tool 4A is a male processing tool having the creasing convex blade 4111. The region L is a processing region. Besides, the first processing body 41 has the interfering members 441 and 442 protruding downward from the lower surface in both end portions in the longitudinal direction of the processing surface 411. The interfering members 441 and 442 are positioned outside the processing region L. Furthermore, as shown in FIG. 6, on a back surface 412 of the first processing body 41, a sliding groove 4121 is formed over the whole length in the longitudinal direction and in the center in a vertical direction.

The second processing body 46 of the second processing tool 4B is a long and narrow rod-shaped member having a substantially rectangular transverse cross section, and has a processing surface 461 on an upper surface as illustrated in FIG. 6. The processing surface 461 has a concave blade 4611 receiving the convex blade 4111 in performing the processing. In other words, the second processing tool 4B is a female processing tool having the concave blade 4611. The concave blade 4611 is formed on the processing surface 461 over the whole length in the longitudinal direction and in the center in a front-back direction. Besides, on a front surface 464 of the second processing body 46, a sliding groove 4641 is formed over the whole length in the longitudinal direction and in the center in the vertical direction as illustrated in FIG. 6.

The first identification section 43 is in the shape of a plate, and is fixed on the tip in the longitudinal direction of the first processing body 41 to protrude beyond the first processing body 41. The first identification section 43 includes information corresponding to the type of processing to be performed by the processing surface 411 of the first processing tool 4A and information corresponding to whether the processing surface 411 faces downward or upward. The second identification section 48 is in the shape of a plate, and is fixed on the tip in the longitudinal direction of the second processing body 46 to protrude beyond the second processing body 46. The second identification section 48 includes information corresponding to the type of processing to be performed by the processing surface 461 of the second processing tool 4B and information corresponding to whether the processing surface 461 faces downward or upward.

(Receiving Unit)

Figure 7:
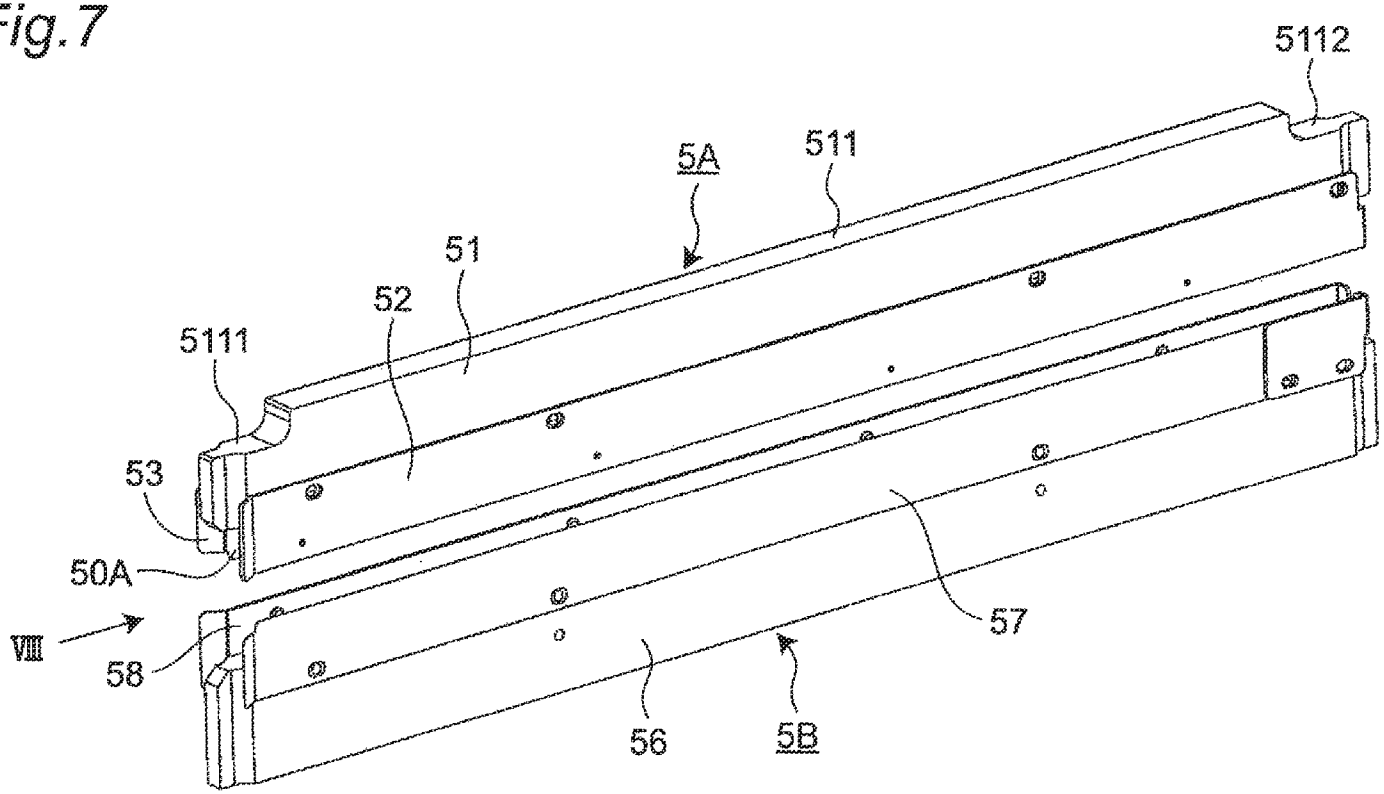
FIG. 7 is a top perspective view of a first receiver and a second receiver.
Figure 8:
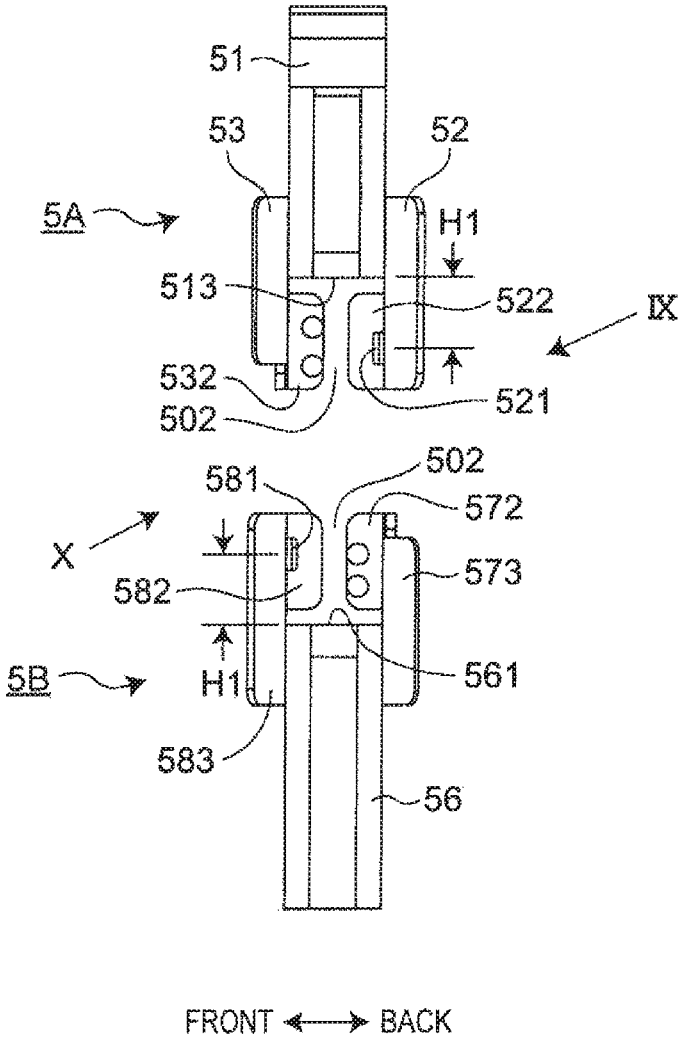
FIG. 8 is a view taken along arrow VIII of FIG. 7.
Figure 9:
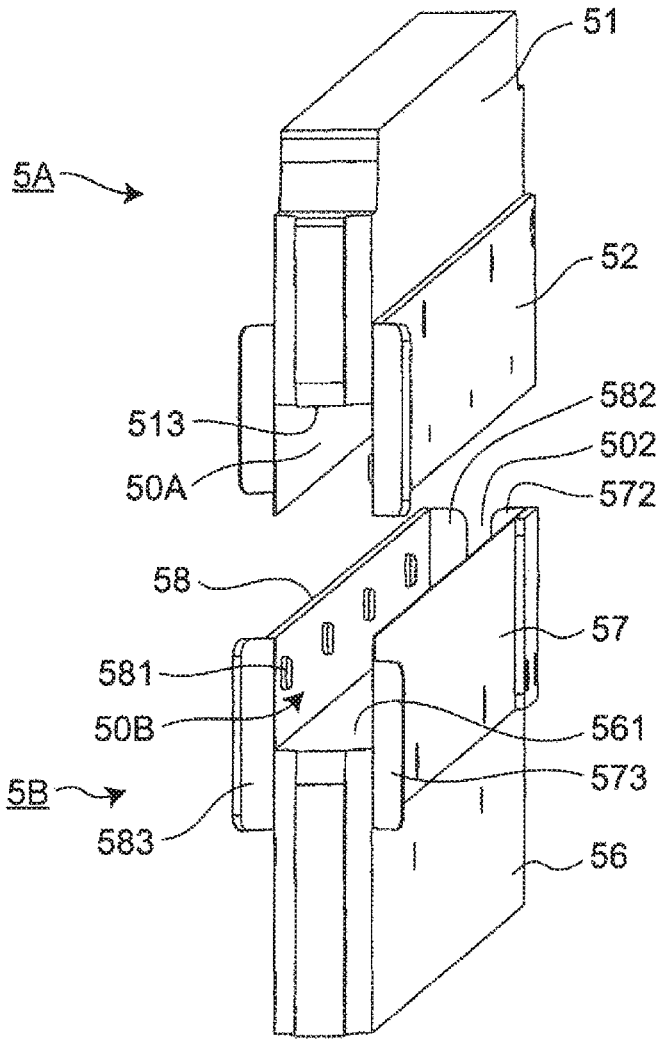
FIG. 9 is a view taken along arrow IX of FIG. 8.
Figure 10:
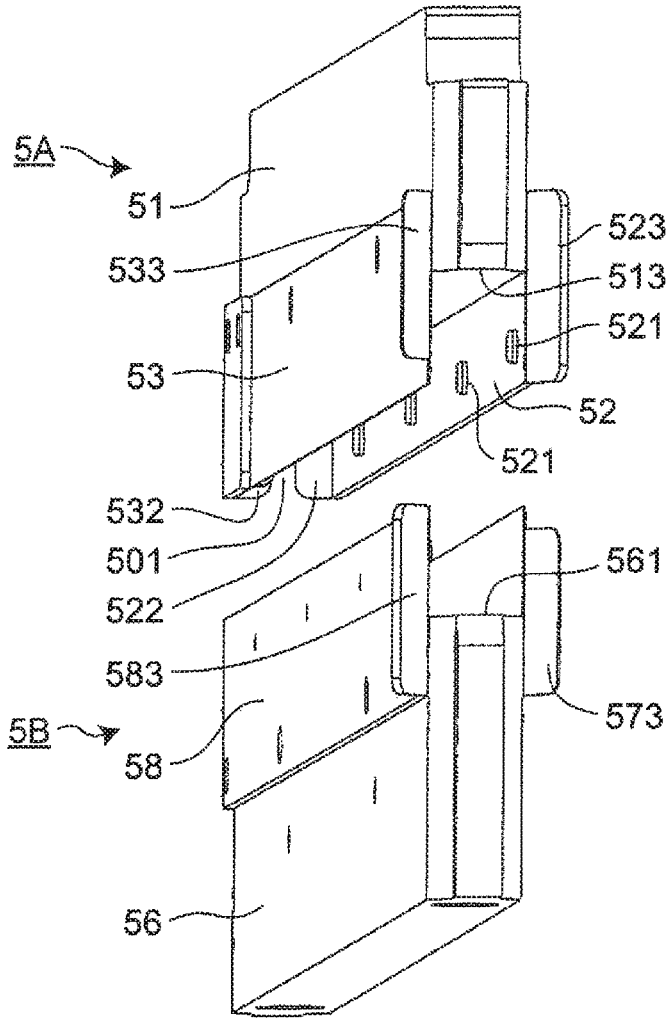
FIG. 10 is a view taken along arrow X of FIG. 8.

As illustrated in FIG. 3, the receiving unit 5 includes a first receiver 5A and a second receiver 5B. FIG. 7 is a top perspective view of the first receiver 5A and the second receiver 5B. FIG. 8 is a view taken along arrow VIII of FIG. 7. FIG. 9 is a view taken along arrow IX of FIG. 8. FIG. 10 is a view taken along arrow X of FIG. 8.

The first receiver 5A includes a first receiver body 51, a back plate 52 and a front plate 53. The first receiver body 51 is a long and narrow plate-shaped member having a rectangular transverse cross section, and has pressing surfaces 5111 and 5112 respectively in end portions in the longitudinal direction of an upper surface 511 thereof. The back plate 52 has an upper portion fixed on the back surface of the first receiver body 51, and the front plate 53 has an upper portion fixed on the front surface of the first receiver body 51. The first receiver 5A has, below the first receiver body 51, a receiving space 50A capable of receiving at least the first processing tool 4A. The receiving space 50A is a space open downward and surrounded by a lower surface 513 of the first receiver body 51, a lower portion of the back plate 52 and a lower portion of the front plate 53. In the receiving space 50A, a large number of (that is, four in this case) projections 521 are provided on an inner surface of the back plate 52. The projections 521 are provided in the same height position in the vertical direction and at intervals in the longitudinal direction. A distance H1 (FIG. 8) between each projection 521 and the lower surface 513 is the same as a distance H1 (FIG. 6) between an upper surface 413 and the sliding groove 4121 in the first processing tool 4A, and is also the same as a distance H1 (FIG. 6) between a lower surface 463 and a sliding groove 4641 in the second processing tool 4B. It is noted that a vertical dimension of each projection 521 is slightly smaller than a vertical dimension of the sliding grooves 4121 and 4641. An inward protrusion 522 is formed in a tip portion in the longitudinal direction of the back plate 52. An inward protrusion 532 is fixed in a tip portion in the longitudinal direction of the front plate 53. The protrusions 522 and 532 are positioned to close a tip portion in the longitudinal direction of the receiving space 50A, but a gap 501 through which the first identification section 43 can pass is provided therebetween. Besides, guide pieces 523 and 533 extending outward are respectively provided in a base portion in the longitudinal direction of the back plate 52 and a base portion in the longitudinal direction of the front plate 53.

The second receiver 5B includes a second receiver body 56, a back plate 57 and a front plate 58. The second receiver body 56 is a long and narrow plate-shaped member having a rectangular transverse cross section. The back plate 57 has a lower portion fixed on a back surface of the second receiver body 56, and the front plate 58 has a lower portion fixed on a front surface of the second receiver body 56. The second receiver 5B has, above the second receiver body 56, a receiving space 50B capable of receiving at least the second processing tool 4B. The receiving space 50B is a space open upward and surrounded by an upper surface 561 of the second receiver body 56, an upper portion of the back plate 57 and an upper portion of the front plate 58. In the receiving space 50B, a large number of (that is, four in this case) projections 581 are provided on an inner surface of the front plate 58. The projections 581 are provided in the same height position in the vertical direction and at intervals in the longitudinal direction. A distance H1 (FIG. 8) between each projection 581 and the upper surface 561 is the same as the distance H1 (FIG. 8) between each projection 521 and the lower surface 513, and therefore is the same as the distance H1 (FIG. 6) between the upper surface 413 and the sliding groove 4121 in the first processing tool 4A, and also the same as the distance H1 (FIG. 6) between the lower surface 463 and the sliding groove 4641 in the second processing tool 4B. It is noted that a vertical dimension of each projection 581 is slightly smaller than the vertical dimension of the sliding grooves 4121 and 4641. An inward protrusion 572 is fixed in a tip portion in the longitudinal direction of the back plate 57. An inward protrusion 582 is formed in a tip portion in the longitudinal direction of the front plate 58.

The protrusions 572 and 582 are positioned to close a tip portion in the longitudinal direction of the receiving space 50B, but a gap 502 through which the second identification section 48 can pass is provided therebetween. Besides, guide pieces 573 and 583 extending outward are respectively provided in a base portion in the longitudinal direction of the back plate 57 and a base portion in the longitudinal direction of the front plate 58.

Figure 11:
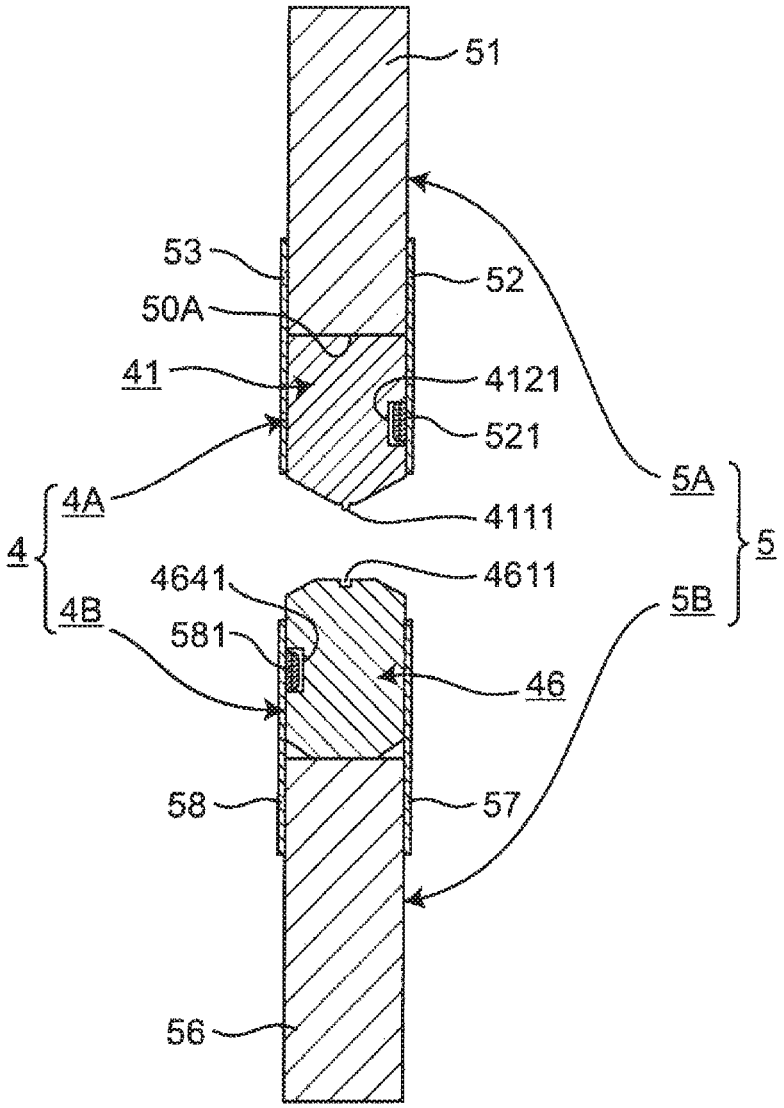
FIG. 11 is a cross-sectional view taken along line XI-XI of FIG. 3.

FIG. 11 is a cross-sectional view taken along line XI-XI of FIG. 3, and illustrates a state where the processing unit 4 is received in the receiving unit 5. The projections 521 are fit in the sliding groove 4121 of the first processing body 41 of the first processing tool 4A. In other words, the first processing body 41 is received in the receiving space 50A with the sliding groove 4121 slid against the large number of projections 521. The first processing body 41 is inserted until the tip portion thereof in the longitudinal direction abuts against the protrusions 522 and 532 (FIG. 8). The first identification section 43 protrudes through the gap 501. The projections 581 are fit in the sliding groove 4641 of the second processing body 46 of the second processing tool 4B. In other words, the second processing body 46 is received in the receiving space 50B with the sliding groove 4641 slid against the large number of projections 581. The second processing body 46 is inserted until the tip portion thereof in the longitudinal direction abuts against the protrusions 572 and 582 (FIG. 8). The second identification section 48 protrudes through the gap 502.

As illustrated in FIG. 2, a tip portion in the longitudinal direction of the first receiver body 51 is vertically slidably supported on the right side plate 32, and a base portion thereof in the longitudinal direction is vertically slidably supported on the left side plate 33, and thus, the first receiver 5A is vertically movably held within the outer frame 30. Springs 71 are disposed between the first receiver 5A and the top plate 31, so that the first receiver 5A can be always biased upward. The two springs 71 are provided on each of the upstream side and the downstream side in the conveyance direction. A tip portion in the longitudinal direction of the second receiver body 56 is vertically slidably supported on the right side plate 32, and a base portion thereof in the longitudinal direction is vertically slidably supported on the left side plate 33, so that the second receiver 5B can be vertically movably held within the outer frame 30 below the first receiver 5A. Springs 72 are disposed between the second receiver 5B and the bottom frame 34, so that the second receiver 5B can be always biased downward. The two springs 72 are provided on each of the upstream side and the downstream side in the conveyance direction.

(Relationship between Processing Unit and Receiving Unit)

Figure 12A:
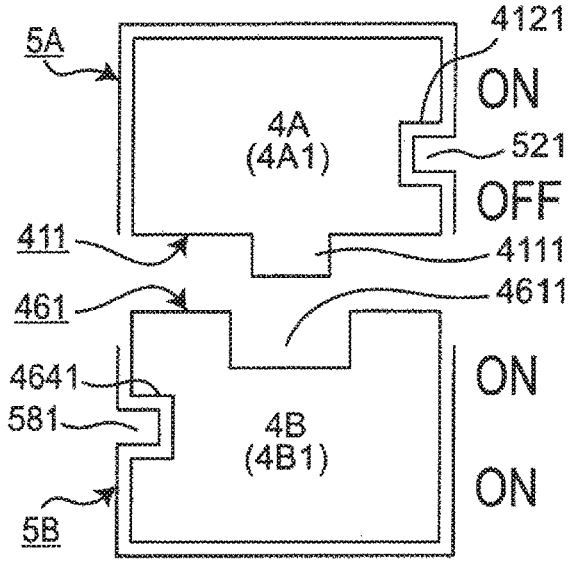
FIGS. 12A to 12D are schematic diagrams illustrating relationships between the processing unit and the receiving unit.

FIGS. 12A to 12D are schematic diagrams illustrating relationships between the processing unit 4 and the receiving unit 5. FIG. 12A is a schematic diagram of FIG. 11. In FIG. 12A, the first processing tool 4A is received in the first receiver 5A with the processing surface 411 (the convex blade 4111) facing downward, and the second processing tool 4B is received in the second receiver 5B with the processing surface 461 (the concave blade 4611) facing upward. In other words, the projections 521 are fit in the sliding groove 4121 of the first processing tool 4A in the first receiver 5A, and the projections 581 are fit in the sliding groove 4641 of the second processing tool 4B in the second receiver 5B. This is designated as a "first processing aspect".

Figure 12C:
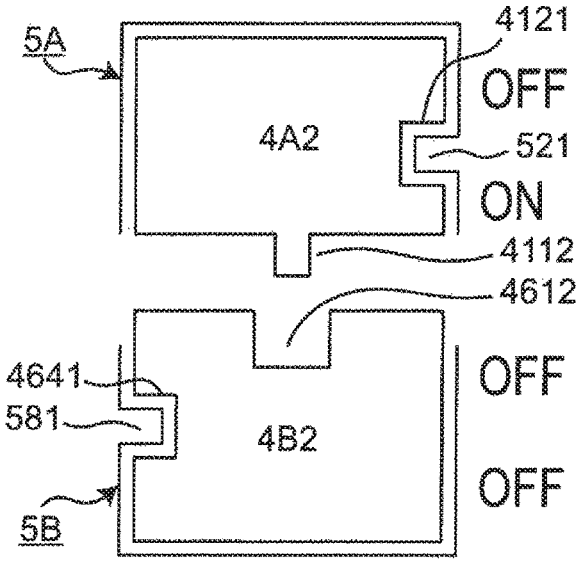
Figure 12B:
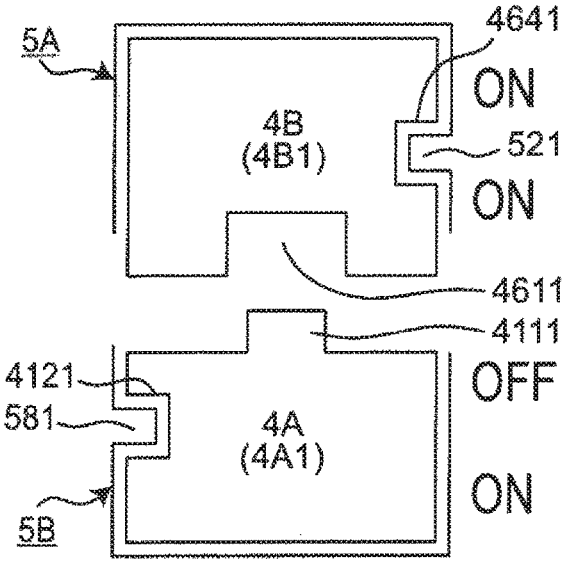
Figure 13:
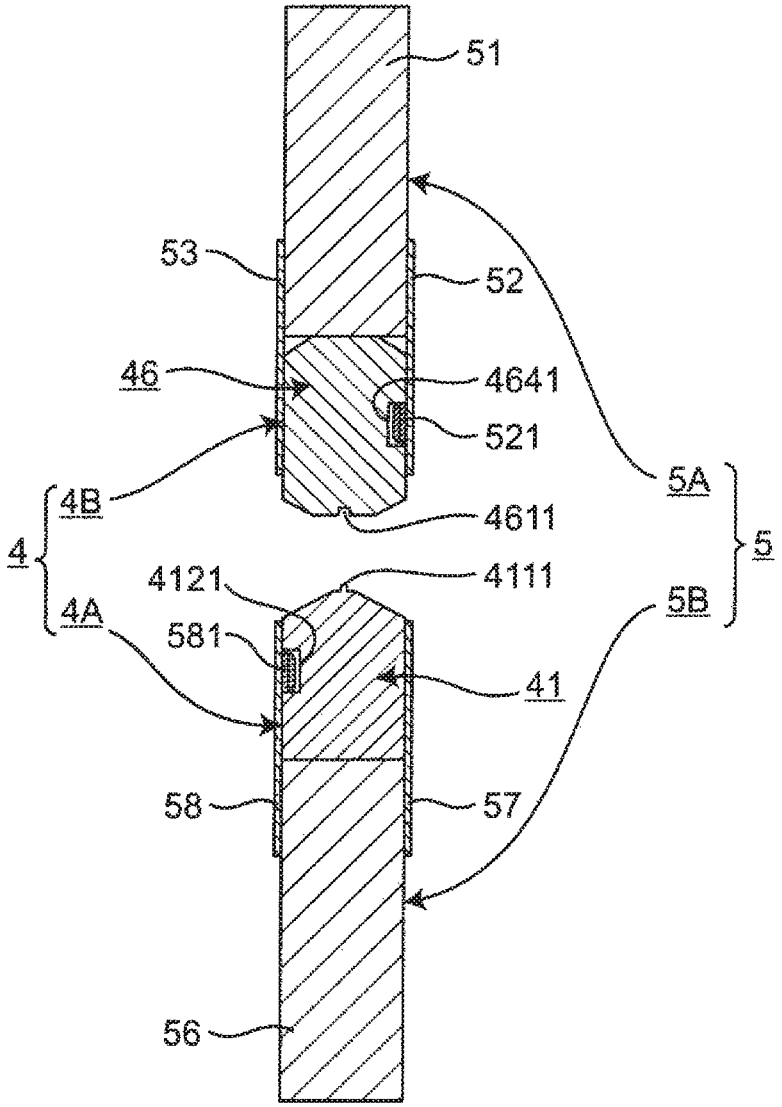
FIG. 13 is a diagram, corresponding to FIG. 11, illustrating a second processing aspect.

In the present embodiment, a "second processing aspect" illustrated in FIG. 12B can be employed. In FIG. 12B, the second processing tool 4B Is received in the first receiver 5A with the concave blade 4611 facing downward, and the first processing tool 4A is received in the second receiver 5B with the convex blade 4111 facing upward. FIG. 12B is a schematic diagram of FIG. 13. Incidentally, in this case, the second processing tool 4B is received in the receiving space 50A of the first receiver 5A with the concave blade 4611 facing downward and with the sliding groove 4641 slid against the projections 521 of the first receiver 5A, and the first processing tool 4A is received in the receiving space 50B of the second receiver 5B with the convex blade 4111 facing upward and with the sliding groove 4121 slid against the projections 581 of the second receiver 5B.

Incidentally, the height position of the processing surface 411 of the first processing tool 4A in the first processing aspect is the same as the height position of the processing surface 461 of the second processing tool 4B in the second processing aspect, and the height position of the processing surface 461 of the second processing tool 4B in the first processing aspect is the same as the height position of the processing surface 411 of the first processing tool 4A in the second processing aspect. In other words, the first processing tool 4A and the second processing tool 4B are substantially the same in the vertical dimension.

(Pressing Mechanism)

As illustrated in FIG. 2, the sheet processor 3 includes, above the first receiver 5A, a pressing mechanism 6 for pressing the first receiver 5A downward. The pressing mechanism 6 includes a rotational shaft 61 extending in the widthwise direction W, and an eccentric cam 62 fixed on the rotational shaft 61. The rotational shaft 61 is provided to be connected to a motor (not shown) provided on the side of the main body 10. The eccentric cam 62 is provided here in both end portions of the rotational shaft 61. The eccentric cams 62 are in contact with the pressing surfaces 5111 and 5112 of the first receiver body 51 of the first receiver 5A. The pressing mechanism 6 lowers the first receiver body 51, that is, the first receiver 5A, namely, lowers the first processing tool 4A received in the first receiver 5A, through the rotation of the eccentric cams 62 with the rotational shaft 61, so as to push the creasing convex blade 4111 into the concave blade 4611, and thus, the sheet processor 3 performs crease processing.

(Position Adjusting Mechanism)

The second receiver 5B is always biased downward by the springs 72 as described above, but is pushed up by a cam mechanism 65 connected to a motor (not shown). Thus, the second receiver 5B, that is, the second processing tool 4B received in the second receiver 5B, can be adjusted in its vertical position.

(Processing Unit Detection Mechanism)

Figure 14:
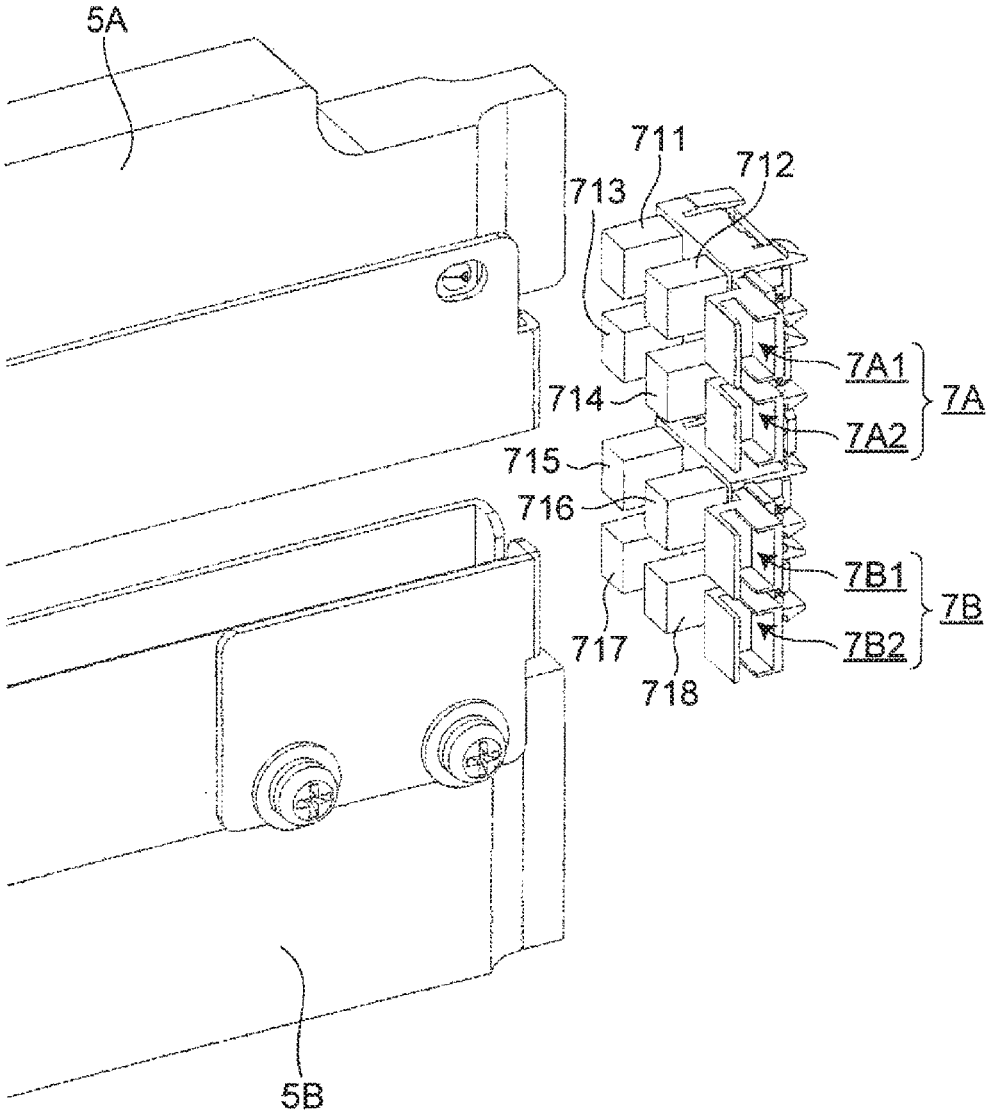
FIG. 14 is a perspective view of a processing unit detection mechanism.

As illustrated in FIG. 2, the sheet processor 3 includes a processing unit detection mechanism 7 outside the right side plate 32. The processing unit detection mechanism 7 is configured to detect the information of the first identification section 43 of the first processing tool 4A and the information of the second identification section 48 of the second processing tool 4B. The processing unit detection mechanism 7 includes, as illustrated in FIG. 14, a first receiver sensor 7A disposed on a tip side of the first receiver 5A and a second receiver sensor 7B disposed on a tip side of the second receiver 5B.

The first receiver sensor 7A includes two pairs of sensors 7A1 and 7A2 vertically arranged. The sensor 7A1 is disposed on an upper side and includes a light emitting portion 711 and a light receiving portion 712, and the sensor 7A2 is disposed on a lower side and includes a light emitting portion 713 and a light receiving portion 714. The first receiver sensor 7A is configured to obtain, from the identification section, detection results as illustrated in FIGS. 15A to 15D. Specifically, four types of detection results of "OFF"-"OFF" of FIG. 15A, "OFF"-"ON" of FIG. 15B, "ON"-"OFF" of FIG. 15C and "ON"-"ON" of FIG. 15D can be obtained. The detection result obtained by the first receiver sensor 7A is designated as the "first detection result".

The second receiver sensor 7B includes two pairs of sensors 7B1 and 7B2 vertically arranged. The sensor 7B1 is disposed on an upper side and includes a light emitting portion 715 and a light receiving portion 716, and the sensor 7B2 is disposed on a lower side and includes a light emitting portion 717 and a light receiving portion 718. The second receiver sensor 7B is configured to obtain, from the identification section, the detection results as illustrated in FIGS. 15A to 15D. Specifically, the four types of detection results of "OFF"-"OFF" of FIG. 15A, "OFF"-"ON" of FIG. 15B, "ON"-"OFF" of FIG. 15C and "ON"-"ON" of FIG. 15D can be obtained. The detection result obtained by the second receiver sensor 7B is designated as the "second detection result".

Thus, the processing unit detection mechanism 7 is configured to obtain a "processing unit detection result" resulting from a combination of the first detection result obtained by the first receiver sensor 7A and the second detection result obtained by the second receiver sensor 7B.

Figure 15C:
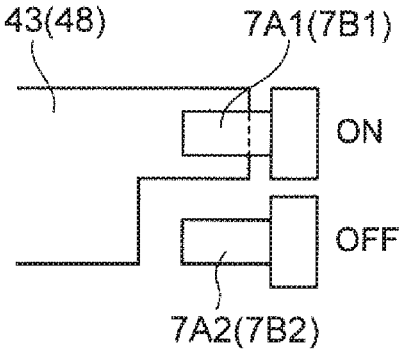
Figure 15B:
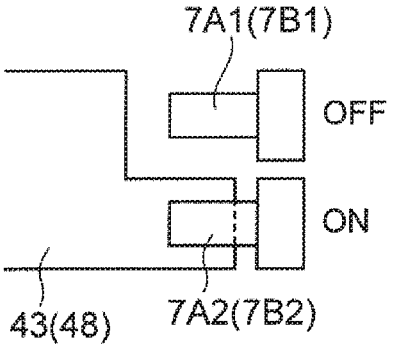
Figure 15D:
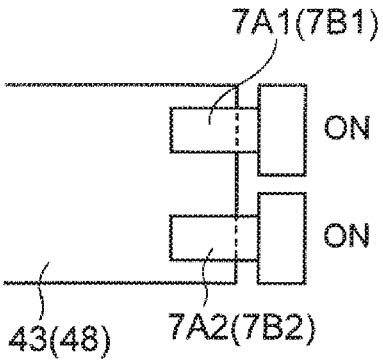
Figure 16:
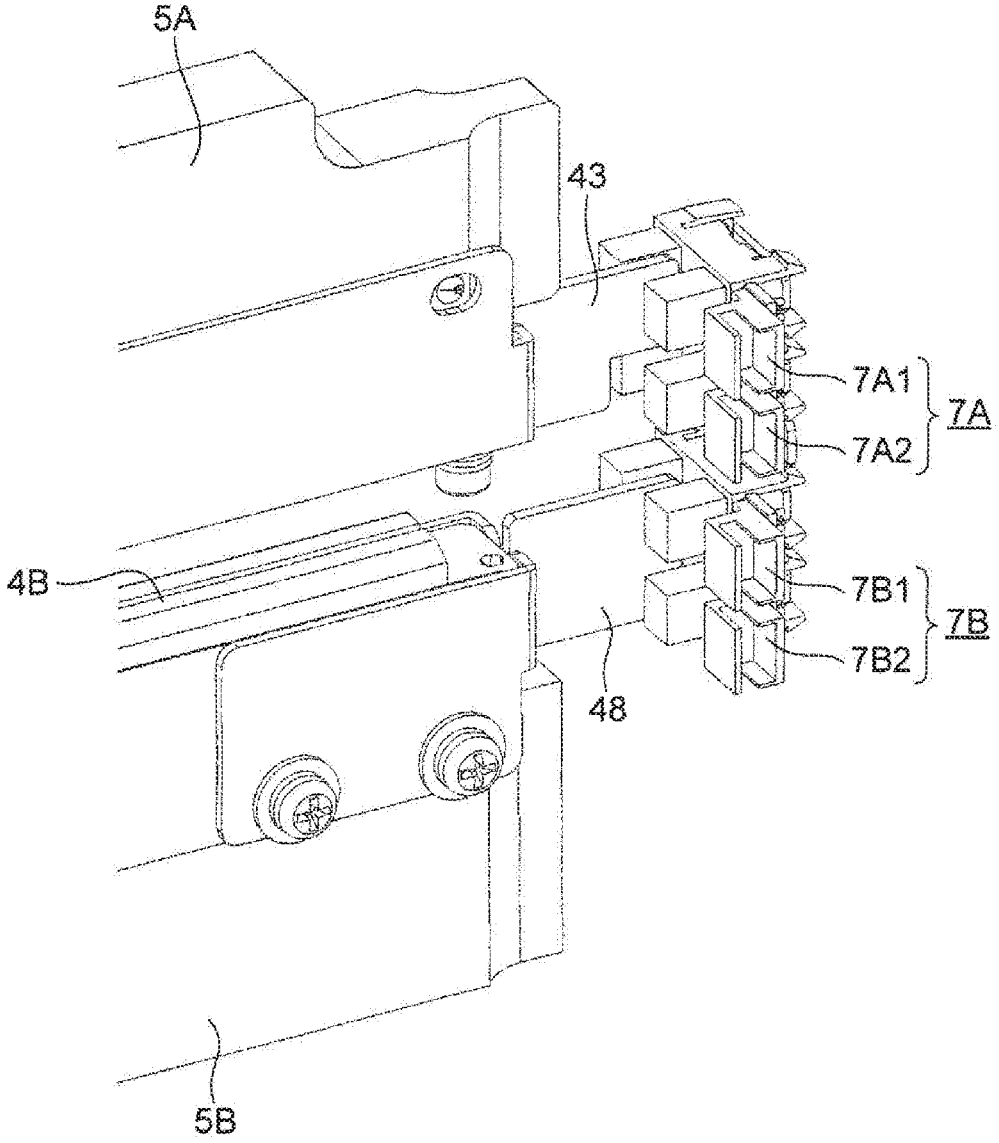
FIG. 16 is a perspective view illustrating a positional relationship between first and second identification sections and first and second receiver sensors in employing the first processing aspect of FIG. 12A.

For example, FIG. 16 is a perspective view illustrating the positional relationship between the first and second identification sections 43 and 48 and the first and second receiver sensors 7A and 7B in employing the first processing aspect of FIG. 12A. In the first processing aspect of FIG. 12A, the first identification section 43 is detected by the first receiver sensor 7A to obtain the first detection result corresponding to a combination of "ON" of the sensor 7A1 and "OFF" of the sensor 7A2 as illustrated in FIG. 15C, and the second identification section 48 is detected by the second receiver sensor 7B to obtain the second detection result corresponding to a combination of "ON" of the sensor 7B1 and "ON" of the sensor 7B2 as illustrated in FIG. 15D. As a result, a processing unit detection result corresponding to a combination of these detection results, "ON"-"OFF"-"ON"-"ON", is obtained as illustrated in FIG. 12A. This processing unit detection result is designated as the "first aspect detection result". Alternatively, in the second processing aspect of FIG. 12B, since the first processing tool 4A is received in the second receiver 5B upside down and the second processing tool 4B is received in the first receiver 5A upside down, the second identification section 48 is detected by the first receiver sensor 7A to obtain the first detection result corresponding to a combination of "ON" of the sensor 7A1 and "ON" of the sensor 7A2 as illustrated in FIG. 15D, and the first identification section 43 is detected by the second receiver sensor 7B to obtain the second detection result corresponding to a combination of "OFF" of the sensor 7B1 and "ON" of the sensor 7B2 as illustrated in FIG. 15B. As a result, a processing unit detection result corresponding to a combination of these detection results, "ON"-"ON"-"OFF"-"ON", is obtained as illustrated in FIG. 12B. This processing unit detection result is designated as the "second aspect detection result".

(Control Unit)

Figure 17:
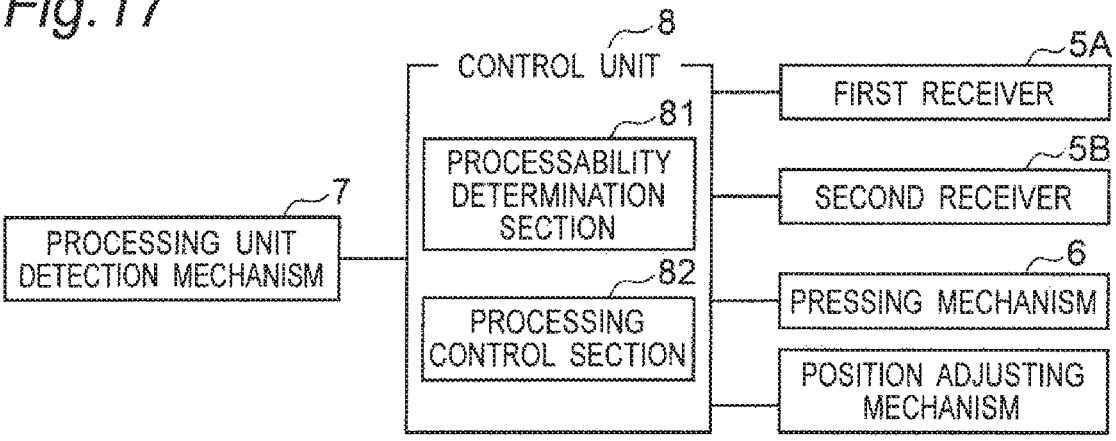
FIG. 17 is a block diagram of a control unit.

A control unit 8 is configured to control the whole operation of the sheet processor 3, and includes a processability determination section 81 and a processing control section 82 in particular as illustrated in a block diagram of FIG. 17.

(1) Processability Determination Section 81

The processability determination section 81 is configured to determine processability based on the processing unit detection result obtained by the processing unit detection mechanism 7. Specifically, the processability determination section 81 is configured to make a determination of "processable" when the processing unit detection result obtained by the processing unit detection mechanism 7 corresponds to a processable processing aspect, and otherwise, make a determination of "unprocessable". Here, the processability determination section 81 is configured to make a determination of "processable" when the processing unit detection result obtained by the processing unit detection mechanism 7 is the first aspect detection result or the second aspect detection result, and make a determination of "unprocessable" when it is neither the first aspect detection result nor the second aspect detection result.

(2) Processing Control Section 82

The processing control section 82 is configured to control a processing operation based on the processing unit detection result obtained by the processing unit detection mechanism 7. In the present embodiment, in a conveyance roller pair provided at least on the downstream side in the conveyance direction of the sheet processor 3, the lower conveyance roller is formed to have higher hardness than the upper conveyance roller. Accordingly, when the sheet 100 is subjected to the processing in the first processing aspect, a creased portion is pinched between the conveyance rollers and is easily crushed. Therefore, in employing the first processing aspect, in order to rather deeply crease the sheet in prospect of crush of a creased portion, relative pressing force between the first processing tool 4A and the second processing tool 4B is preferably increased as compared with a case employing the second processing aspect. Specifically, the position adjusting mechanism is controlled so that the pressing force of the second processing tool 4B against the first processing tool 4A can be larger when employing the second processing aspect than when the processing unit detection result obtained by the processing unit detection mechanism 7 is the first aspect detection result.

(Operational Advantages)

The sheet processor 3 having the above-described structure and also the sheet processing apparatus 1 exhibit the following operational advantages.

(1) Since the first receiver 5A and the second receiver 5B can respectively receive the first processing tool 4A and the second processing tool 4B in a state capable of performing processing, the first processing aspect can be realized, and since the first receiver 5A and the second receiver 5B can respectively receive the second processing tool 4B and the first processing tool 4A in a state capable of performing the processing, the second processing aspect can be realized. Accordingly, the front surface of a sheet can be subject to the crease processing in the first processing aspect, and the back surface of the sheet can be subjected to the crease processing in the second processing aspect. In other words, according to the sheet processor 3 having the above-described structure, the front surface, or the back surface of a sheet can be subjected to the processing by employing either of the processing aspects without turning the sheet over. As a result, workability can be improved.

(2) When two types of first processing tools 4A1 and 4A2 respectively of the first and second types are prepared as the first processing tool and second processing tools 4B1 and 4B2 respectively corresponding to the first processing tools 4A1 and 4A2 are prepared as the second processing tool, the front surface or the back surface of a sheet can be subjected to processing selected from two types of processing by employing either of the processing aspects without turning the sheet over.

An exemplified case where the two types of the first processing tools 4A1 and 4A2 and the two types of the second processing tools 4B1 and 4B2 are used as illustrated in FIGS. 12A to 12D will now be described. The first processing tool 4A1 and the second processing tool 4B1 are respectively the same as the first processing tool 4A and the second processing tool 4B described above. FIGS. 12A and 12B respectively illustrate the first processing aspect and the second processing aspect using the first processing tool 4A1 and the second processing tool 4B1. The sheet processor 3 can perform the crease processing on the front surface or the back surface of a sheet without turning the sheet over by employing the first processing aspect or the second processing aspect as described above.

Figure 12D:
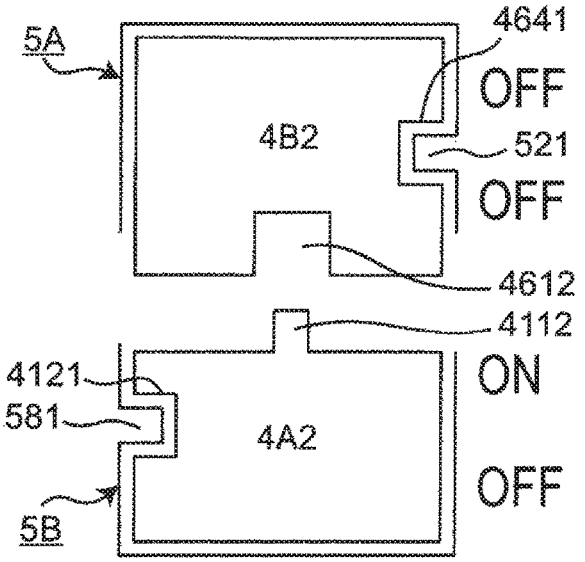

The first processing tool 4A2 is the same as the first processing tool 4A1 except that it has a creasing convex blade 4112 with a smaller width than the creasing convex blade 4111 of the first processing tool 4A1. The second processing tool 4B2 is the same as the second processing tool 4B1 except that it has a concave blade 4612 corresponding to the convex blade 4112 of the first processing tool 4A2. The concave blade 4612 of the second processing tool 4B2 has a smaller width than the concave blade 4611 of the second processing tool 4B1. FIGS. 12C and 12D respectively illustrate a third processing aspect and a fourth processing aspect using the first processing tool 4A2 and the second processing tool 4B2. In the third processing aspect, the first processing tool 4A2 is received in the first receiver 5A with the convex blade 4112 facing downward, and the second processing tool 4B2 is received in the second receiver 5B with the concave blade 4612 facing upward. In other words, the projections 521 are fit in the sliding groove 4121 of the first processing tool 4A2 in the first receiver 5A, and the projections 581 are fit in the sliding groove 4641 of the second processing tool 4B2 in the second receiver 5B. In the fourth processing aspect, the second processing tool 4B2 is received in the first receiver 5A with the concave blade 4612 facing downward, and the first processing tool 4A2 is received in the second receiver 5B with the convex blade 4112 facing upward. In other words, the projections 521 are fit in the sliding groove 4641 of the second processing tool 4B2 in the first receiver 5A, and the projections 581 are fit in the sliding groove 4121 of the first processing tool 4A2 in the second receiver 5B. Accordingly, narrow crease processing can be performed on the front surface of a sheet by employing the third processing aspect, and the narrow crease processing can be performed on the back surface of the sheet by employing the fourth processing aspect. In other words, the sheet processor 3 can perform the narrow crease processing on the front surface or the back surface of a sheet without turning the sheet over by employing the third processing aspect or the fourth processing aspect.

As described so far, when the two types of the first processing tools 4A1 and 4A2 and the two types of the second processing tools 4B1 and 4B2 are used as illustrated in FIGS. 12A to 12D, the crease processing can be performed with a width selected from the two types of the widths, namely, with a width of the processing selected from the two types of processing performed with different widths, on the front surface or the back surface of a sheet without turning the sheet over by employing any of the processing aspects.

Figure 15A:
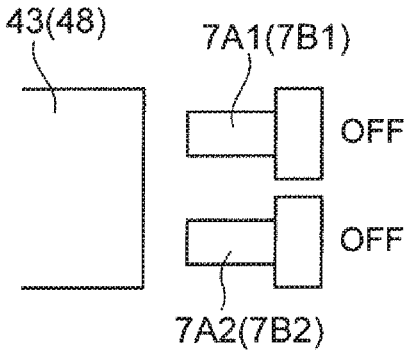
FIGS. 15A to 15D are diagrams illustrating a first example of a detection result obtained by sensors of the processing unit detection mechanism.

Incidentally, in this case, in the third processing aspect of FIG. 12C, the first identification section 43 is detected by the first receiver sensor 7A to obtain the first detection result corresponding to a combination of "OFF" of the sensor 7A1 and "ON" of the sensor 7A2 as illustrated in FIG. 15B, and the second identification section 48 is detected by the second receiver sensor 7B to obtain the second detection result corresponding to a combination of "OFF" of the sensor 7B1 and "OFF" of the sensor 7B2 as illustrated in FIG. 15A. As a result, a processing unit detection result corresponding to a combination of these combinations, "OFF"-"ON"-"OFF"-"OFF", is obtained as illustrated in FIG. 12C. This processing unit detection result is designated as the third aspect detection result. Alternatively, in the fourth processing aspect of FIG. 12D, the second identification section 48 is detected by the first receiver sensor 7A to obtain the first detection result corresponding to a combination of "OFF" of the sensor 7A1 and "OFF" of the sensor 7A2 as illustrated in FIG. 15A, and the first identification section 43 is detected by the second receiver sensor 7B to obtain the second detection result corresponding to a combination of "ON" of the sensor 7B1 and "OFF" of the sensor 7B2 as illustrated in FIG. 15C. As a result, a processing unit detection result corresponding to a combination of these combinations, "OFF"-"OFF"-"ON"-"OFF", is obtained as illustrated in FIG. 12D. This processing unit detection result is designated as the fourth aspect detection result. Besides, the processability determination section 81 is configured to make a determination of "processable" when the processing unit detection result obtained by the processing unit detection mechanism 7 is the first, second, third or fourth aspect detection result, and make a determination of "unprocessable" when it is none of the first, second, third and fourth aspect detection results.

(3) In the case where two types of first processing tools 4A, namely, two types of male processing tools, are prepared, when the first processing, tools 4A are to be attached by sliding on both the first receiver 5A and the second receiver 5B, the interfering members 441 and 442 of these tools interfere with each other. As a result, an operator is caused to recognize that he/she is trying to attach the male processing tools on both the first receiver 5A and the second receiver 5B. Accordingly, a mistake of attaching the male processing tools alone on both the first receiver 5A and the second receiver 5B can be prevented.

(4) The handle 422 and the handle 472 are disposed in positions shifted from each other in the widthwise direction W as illustrated in FIG. 2. In other words, these handles are positioned so as not to vertically overlap each other. Accordingly, even when the contour of each handle protrudes in the vertical direction beyond the upper end or the lower end of the processing tool, the handles do not interfere with each other, and hence, the handles do not inhibit the vertical movement of the processing tools.

Now, various modifications of the above-described embodiment will be described. It is noted that same reference signs are used to refer to same or corresponding elements.

(Modification 1)

As illustrated in FIGS. 18A to 18D, one type of a first processing tool 4A3 and two types of second processing tools 4B1 and 4B2 are used. The first processing tool 4A3 has a creasing convex blade 4111 on a processing surface 411 corresponding to a lower surface, has a creasing convex blade 4112 on a processing surface 413 corresponding to an upper surface, and further has sliding grooves 4121 and 4141 respectively on side surfaces in the same position. The rest of the structure is the same as that of the above-described embodiment. It is noted that the first receiver 5A and the second receiver 5B are not illustrated in FIGS. 18A to 18D because they are the same as those illustrated in FIGS. 12A to 12D.

Figure 18A:
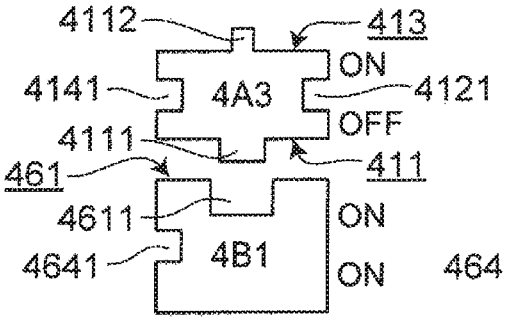
FIGS. 18A to 18D are schematic transverse cross-sectional views illustrating processing aspects of a processing unit according to Modification 1.

In a first processing aspect of FIG. 18A, the first processing tool 4A3 is received in one first receiver 5A with the convex blade 4111 facing downward, and the second processing tool 4B1 is received in the second receiver 5B with the concave blade 4611 facing upward. In other words, the projections 521 are fit in the sliding groove 4121 of the first processing tool 4A3 in the first receiver 5A, and the projections 581 are fit in the sliding groove 4641 of the second processing tool 4B1 in the second receiver 5B. Thus, a processing unit detection result of "ON"-"OFF"-"ON"-"ON" is obtained in employing the first processing aspect of FIG. 18A.

Figure 18C:
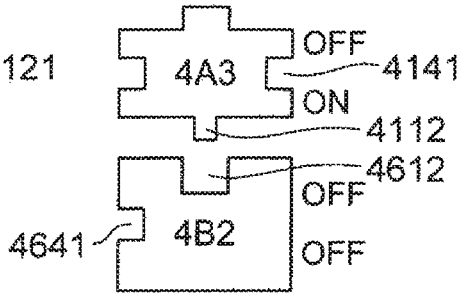
Figure 18B:
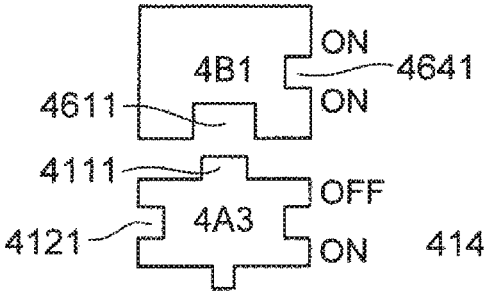

In a second processing aspect of FIG. 18B, the second processing tool 4B1 is received in the first receiver 5A with the concave blade 4611 facing downward, and the first processing tool 4A3 is received in the second receiver 5B with the convex blade 4111 facing upward. In other words, the projections 521 are fit in the sliding groove 4641 of the second processing tool 4B1 in the first receiver 5A, and the projections 581 are fit in the sliding groove 4121 of the first processing tool 4A3 in the second receiver 5B. Thus, a processing unit detection result of "ON"-"ON"-"OFF"-"ON" is obtained in employing the second processing aspect of FIG. 18B.

In a third processing aspect of FIG. 18C, the first processing tool 4A3 is received in the first receiver 5A with the convex blade 4112 facing downward, and the second processing tool 4B2 is received in the second receiver 5B with the concave blade 4612 facing upward. In other words, the projections 521 are fit in the sliding groove 4141 of the first processing tool 4A3 in the first receiver 5A, and the projections 581 are fit in the sliding groove 4641 of the second processing tool 4B2 in the second receiver 5B. Thus, a processing unit detection result of "OFF"-"ON"-"OFF"-"OFF" is obtained in employing the third processing aspect of FIG. 18C.

Figure 18D:
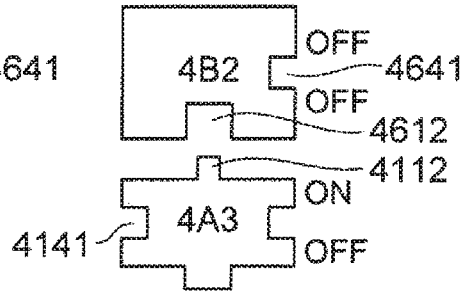

In a fourth processing aspect of FIG. 18D, the second processing tool 4B2 is received in the first receiver 5A with the concave blade 4612 facing downward, and the first processing tool 4A3 is received in the second receiver 5B with the convex blade 4112 facing upward. In other words, the projections 521 are fit in the sliding groove 4641 of the second processing tool 4B2 in the first receiver 5A, and the projections 581 are fit in the sliding groove 4141 of the first processing tool 4A3 in the second receiver 5B. Thus, a processing unit detection result of "OFF"-"OFF"-"ON"-"OFF" is obtained in employing the fourth processing aspect of FIG. 18D.

(Modification 2)

As illustrated in FIGS. 19A to 19D, two types of first processing tools 4A1 and 4A2 and one type of a second processing tool 4B3 are used. The second processing tool 4B3 has a concave blade 4611 on a processing surface 461 corresponding to an upper surface, has a concave blade 4612 on a processing surface 463 corresponding to a lower surface, and further has sliding grooves 4621 and 4641 respectively on side surfaces in the same position. The rest of the structure is the same as that of the above-described embodiment and modification. It is noted that the first receiver 5A and the second receiver 5B are not illustrated in FIGS. 19A to 19D because they are the same as those illustrated in FIGS. 12A to 12D.

Figure 19A:
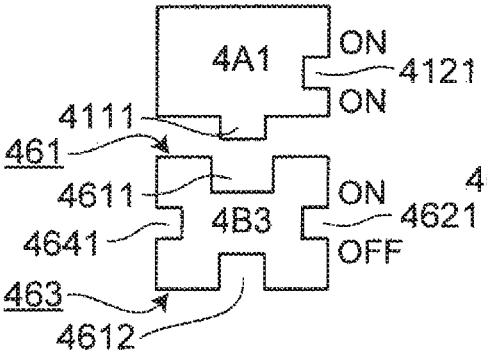
FIGS. 19A to 19D are schematic transverse cross-sectional views illustrating processing aspects of a processing unit according to Modification 2.

In a first processing aspect of FIG. 19A, the first processing tool 4A1 is received in the first receiver 5A with the convex blade 4111 facing downward, and the second processing tool 4B3 is received in the second receiver 5B with the concave blade 4611 facing upward. In other words, the projections 521 are fit in the sliding groove 4121 of the first processing tool 4A1 in the first receiver 5A, and the projections 581 are fit in the sliding groove 4641 of the second processing tool 4B3 in the second receiver 5B. Thus, a processing unit detection result of "ON"-"ON"-"ON"-"OFF" is obtained in employing the first processing aspect of FIG. 19A.

Figure 19C:
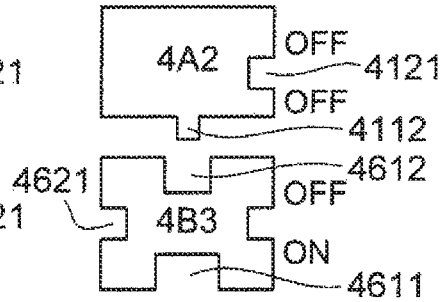
Figure 19B:
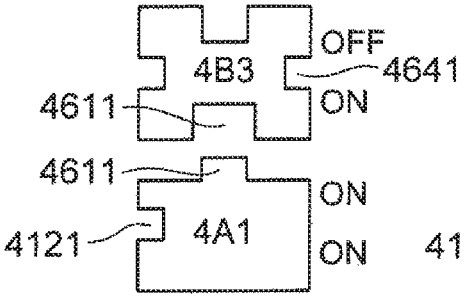

In a second processing aspect of FIG. 19B, the second processing tool 4B3 is received in the first receiver 5A with the concave blade 4611 facing downward, and the first processing tool 4A1 is received in the second receiver 5B with the convex blade 4111 facing upward. In other words, the projections 521 are fit in the sliding groove 4641 of the second processing tool 4B3 in the first receiver 5A, and the projections 581 are fit in the sliding groove 4121 of the first processing tool 4A1 in the second receiver 5B. Thus, a processing unit detection result of "OFF"-"ON"-"ON"-"ON" is obtained in employing the second processing aspect of FIG. 19B.

In a third processing aspect of FIG. 19C, the first processing tool 4A2 is received in the first receiver 5A with the convex blade 4112 facing downward, and the second processing tool 4B3 is received in the second receiver 5B with the concave blade 4612 facing upward. In other words, the projections 521 are fit in the sliding groove 4121 of the first processing tool 4A2 in the first receiver 5A, and the projections 581 are fit in the sliding groove 4621 of the second processing tool 4B3 in the second receiver 5B. Thus, a processing unit detection result of "OFF"-"OFF"-"OFF"-"ON" is obtained in employing the third processing aspect of FIG. 19C.

Figure 19D:
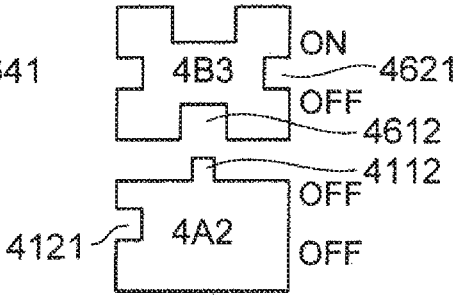

In a fourth processing aspect of FIG. 19D, the second processing tool 4B3 is received in the first receiver 5A with the concave blade 4612 facing downward, and the first processing tool 4A2 is received in the second receiver 5B with the convex blade 4112 facing upward. In other words, the projections 521 are fit in the sliding groove 4621 of the second processing tool 4B3 in the first receiver 5A, and the projections 581 are fir in the sliding groove 4121 of the first processing tool 4A2 in the second, receiver 5B. Thus, a processing unit detection result of "ON"-"OFF"-"OFF"-"OFF" is obtained in employing the fourth processing aspect of FIG. 19D.

(Modification 3)

As illustrated in FIGS. 20A to 20D, two types of first processing tools 4A1 and 4A4 and two types of second processing tools 4B1 and 4B4 are used. The first processing tool 4A4 is the same as the first processing tool 4A1 except that it has a perforating blade 4113 on a processing surface 411. The second processing tool 4B4 is the same as the second processing tool 4B1 except that it has a processing surface 461 in the shape of a plane perforating blade rest. It is noted that the first receiver 5A and the second receiver 5B are not illustrated in FIGS. 20A to 20D because they are the same as those illustrated in FIGS. 12A 12D.

Figure 20A:
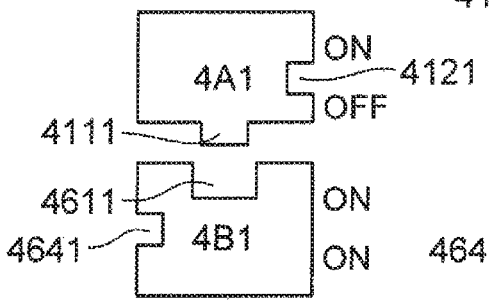
FIGS. 20A to 20D are schematic transverse cross-sectional views illustrating processing aspects of a processing unit according to Modification 3.

In a first processing aspect of FIG. 20A, the first processing tool 4A1 is received in the first receiver 5A with the convex blade 4111 facing downward, and the second processing tool 4B1 is received in the second receiver 5B with the concave blade 4611 facing upward. In other words, the projections 521 are fit in the sliding groove 4121 of the first processing tool 4A1 in the first receiver 5A, and the projections 581 are fit in the sliding groove 4641 of the second processing tool 4B1 in the second receiver 5B. Thus, a processing unit detection result of "ON"-"OFF"-"ON"-"ON" is obtained in employing the first processing aspect of FIG. 20A.

Figure 20C:
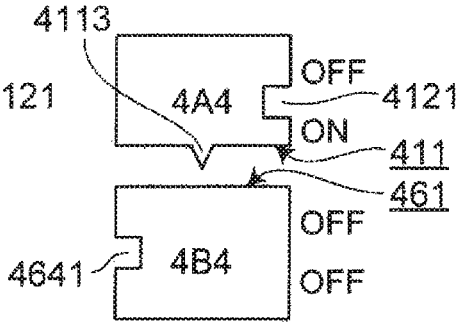
Figure 20B:
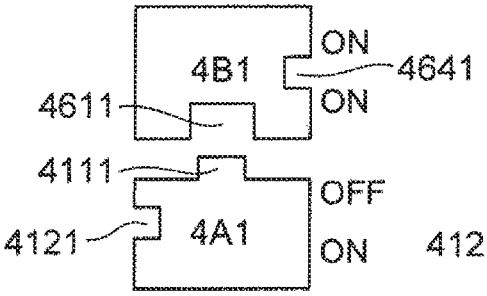

In a second processing aspect of FIG. 20B, the second processing tool 4B1 is received in the first receiver 5A with the concave blade 4611 facing downward, and the first processing tool 4A1 is received in the second receiver 5B with the convex blade 4111 facing upward. In other words, the projections 521 are fit in the sliding groove 4641 of the second processing tool 4B1 in the first receiver 5A, and the projections 581 are fit in the sliding groove 4121 of the first processing tool 4A1 in the second receiver 5B. Thus, a processing unit detection result of "ON"-"ON"-"OFF"-"ON" is obtained in employing the second processing aspect of FIG. 20B.

In a third processing aspect of FIG. 20C, the first processing tool 4A4 is received in the first receiver 5A with the perforating blade 4113 facing downward, and the second processing tool 4B4 is received in the second receiver 5B with the processing surface 461 facing upward. In other words, the projections 521 are fit in the sliding groove 4121 of the first processing tool 4A4 in the first receiver 5A, and the projections 581 are fit in the sliding groove 4641 of the second processing tool 4B4 in the second receiver 5B. Thus, a processing unit detection result of "OFF"-"ON"-"OFF"-"OFF" is obtained in employing the third processing aspect of FIG. 20C.

Figure 20D:
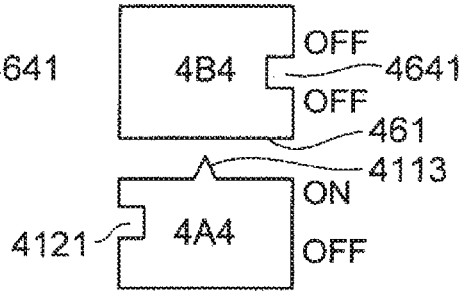

In a fourth processing aspect of FIG. 20D, the second processing tool 4B4 is received in the first receiver 5A with the processing surface 461 facing downward, and the first processing tool 4A4 is received in the second receiver 5B with the perforating blade 4113 facing upward. In other words, the projections 521 are fit in the sliding groove 4641 of the second processing tool 4B4 in the first receiver 5A, and the projections 581 are fit in the sliding groove 4121 of the first processing tool 4A4 in the second receiver 5B. Thus, a processing unit detection result of "OFF"-"OFF"-"ON"-"OFF" is obtained in employing the fourth processing aspect of FIG. 20D.

(Modification 4)

As illustrated in FIGS. 21A to 21D, two types of first processing tools 4A1 and 4A4 and two types of second processing tools 4B1 and 4B4 are used. It Is noted that the first receiver 5A and the second receiver 5B are not illustrated in FIGS. 21A to 21*d* because they are the same as those illustrated in FIGS. 12A to 12D.

Figure 21A:
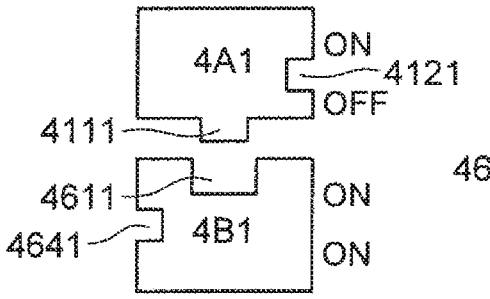
FIGS. 21A to 21D are schematic transverse cross-sectional views illustrating processing aspects of a processing unit according to Modification 4.

In a first processing aspect of FIG. 21A, the first processing tool 4A1 is received in the first receiver 5A with the convex blade 4111 facing downward, and the second processing tool 4B1 is received in the second receiver 5B with the concave blade 4611 facing upward. In other words, the projections 521 are fit in the sliding groove 4121 of the first processing tool 4A1 in the first receiver 5A, and the projections 581 are fit in the sliding groove 4641 of the second processing tool 4B1 in the second receiver 5B. Thus, a processing unit detection result of "ON"-"OFF"-"ON"-"ON" is obtained in employing the first processing aspect of FIG. 21A.

Figure 21C:
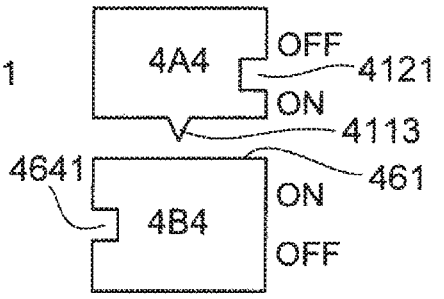
Figure 21B:
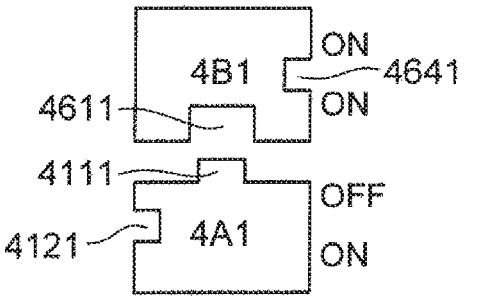

In a second processing aspect of FIG. 21B, the second processing tool 4B1 is received in the first receiver 5A with the concave blade 4611 facing downward, and the first processing tool 4A1 is received in the second receiver 5B with the convex blade 4111 facing upward. In other words, the projections 521 are fit in the sliding groove 4641 of the second processing tool 4B1 in the first receiver 5A, and the projections 581 are fit in the sliding groove 4121 of the first processing tool 4A1 in the second receiver 5B. Thus, a processing unit detection result of "ON"-"ON"-"OFF"-"ON" is obtained in employing the second processing aspect of FIG. 21B.

In a third processing aspect of FIG. 21C, the first processing tool 4A4 is received in the first receiver 5A with the perforating blade 4113 facing downward, and the second processing tool 4B4 is received in the second receiver 5B with the processing surface 461 facing upward. In other words, the projections 521 are fit in the sliding groove 4121 of the first processing tool 4A4 in the first receiver 5A, and the projections 581 are fit in the sliding groove 4641 of the second processing tool 4B4 in the second receiver 5B. Thus, a processing unit detection result of "OFF"-"ON"-"OFF"-"OFF" is obtained in employing the third processing aspect of FIG. 21C. Incidentally, in the third processing aspect, the second processing tool 4B4 may be received in the first receiver 5A with the processing surface 461 facing downward and the first processing tool 4A4 may be received in the second receptor 5B with the perforating blade 4113 facing upward.

Figure 21D:
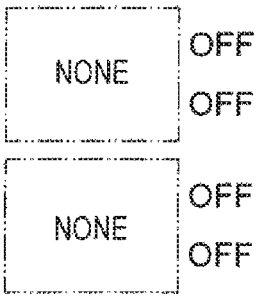

Incidentally, a fourth processing aspect of FIG. 21D corresponds to a state where no processing tool is used, and a processing unit detection result of "OFF"-"OFF"-"OFF"-"OFF" is obtained.

(Modification 5)

As illustrated in FIGS. 22A to 22D, one type of a first processing tool 4A4 and one type of a second processing tool 4B5 are used. The second processing tool 4B5 has a perforating blade rest of a recess 4613 on a processing surface 461 corresponding to an upper surface, has a plane perforating blade rest of a processing surface 463 corresponding to a lower surface, and further has sliding grooves 4621 and 4641 respectively on side surfaces. It is noted that the first receiver 5A and the second receiver 5B are not illustrated in FIGS. 22A to 22D because they are the same as those illustrated in FIGS. 12A to 12D.

Figure 22A:
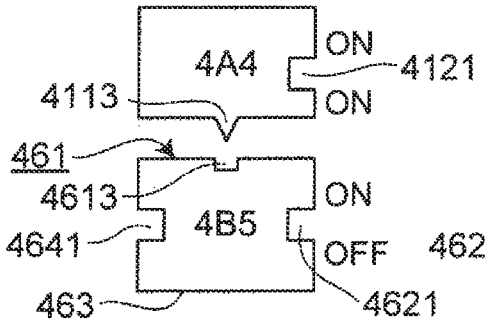
FIGS. 22A to 22D are schematic transverse cross-sectional views illustrating processing aspects of a processing unit according to Modification 5.

In a first processing aspect of FIG. 22A, the first processing tool 4A4 is received in the first receiver 5A with the perforating blade 4113 facing downward, and the second processing tool 4B5 is received in the second receiver 5B with the recess 4613 facing upward. In other words, the projections 521 are fit in the sliding groove 4121 of the first processing tool 4A4 in the first receiver 5A, and the projections 581 are fit in the sliding groove 4641 of the second processing tool 4B5 in the second receiver 5B. Thus, a processing unit detection result of "ON"-"ON"-"ON"-"OFF" is obtained in employing the first processing aspect of FIG. 22A.

Figure 22C:
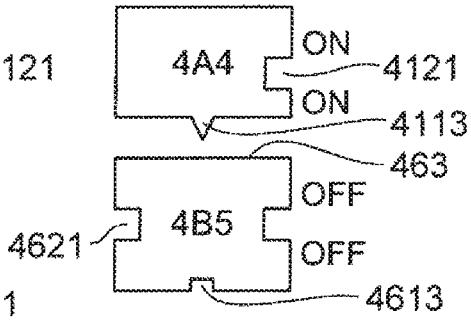
Figure 22B:
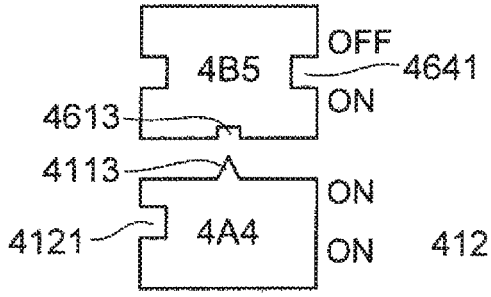

In a second processing aspect of FIG. 22B, the second processing tool 4B5 is received in the first receiver 5A with the recess 4613 facing downward, and the first processing tool 4A4 is received in the second receiver 5B with the perforating blade 4113 facing upward. In other words, the projections 521 are fit in the sliding groove 4641 of the second processing tool 4B5 in the first receiver 5A, and the projections 581 are fit in the sliding groove 4121 of the first processing tool 4A4 in the second receiver 5B. Thus, a processing unit detection result of "OFF"-"ON"-"ON"-"ON" is obtained in employing the second processing aspect of FIG. 22B.

In a third processing aspect of FIG. 22C, the first processing tool 4A4 is received in the first receiver 5A with the perforating blade 4113 facing downward, and the second processing tool 4B5 Is received in the second receiver 5B with the processing surface 463 facing upward. In other words, the projections 521 are fit in the sliding groove 4121 of the first processing tool 4A4 in the first receiver 5A, and the projections 581 are fit in the sliding groove 4621 of the second processing tool 4B5 in the second receiver 5B. Thus, a processing unit detection result of "ON"-"ON"-"OFF"-"ON" is obtained in employing the third processing aspect of FIG. 22C.

Figure 22D:
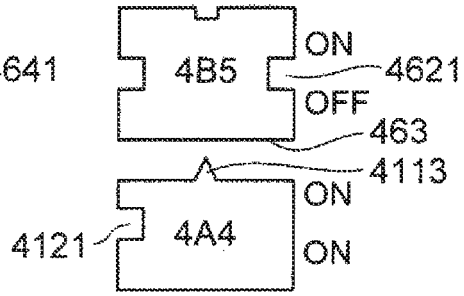

In a fourth processing aspect of FIG. 22D, the second processing tool 4B5 is received in the first receiver 5A with the processing surface 463 facing downward, and the first processing tool 4A4 is received in the second receiver 5B with the perforating blade 4113 facing upward. In other words, the projections 521 are fit in the sliding groove 4621 of the second processing tool 4B5 in the first receiver 5A, and the projections 581 are fit in the sliding groove 4121 of the first processing tool 4A4 in the second receiver 5B. Thus, a processing unit detection result of "ON"-"OFF"-"ON"-"ON" is obtained in employing the fourth processing aspect of FIG. 22D.

Incidentally, in this modification, perforation processing is performed without causing the tip of the perforating blade 4113 to come into contact with the bottom of the recess 4613 on the processing surface 461 of the second processing tool 4B5 in the first processing aspect and the second processing aspect, and therefore, abrasion of the perforating blade 4113 can be suppressed as compared with that caused in the third processing aspect and the fourth processing aspect. Besides, the perforation processing is performed with the sheet 100 pressed against the processing surface 463 of the second processing tool 4B5 in the third processing aspect and the fourth processing aspect, and therefore, expansion toward the second processing, tool 4B5 of perforated portions of the sheet 100 can be inhibited as compared with that caused in the first processing aspect and the second processing aspect.

(Modification 6)

As illustrated in FIGS. 23A to 23D, two types of first processing tools 4A4 and 4A5 and one type of a second processing tool 4B4 are used. The first processing tool 4A5 is the same as the first processing tool 4A1 except that it has a micro perforating blade 4114 on a processing surface 411. It is noted that the first receiver 5A and the second receiver 5B are not Illustrated in FIGS. 23A to 23D because they are the same as those illustrated in FIGS. 12A to 12D.

Figure 23A:
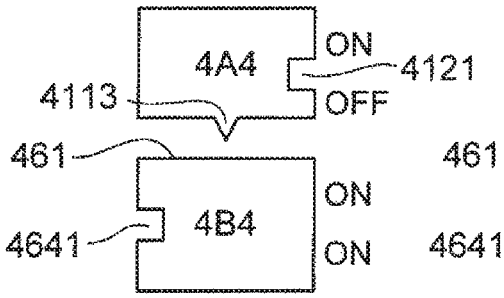

In a first processing aspect of FIG. 23A, the first processing tool 4A4 is received in the first receiver 5A with the perforating blade 4113 facing downward, and the second processing tool 4B4 is received in the second receiver 5B with the processing surface 461 facing upward. In other words, the projections 521 are fit in the sliding groove 4121 of the first processing tool 4A4 in the first receiver 5A, and the projections 581 are fit in the sliding groove 4641 of the second processing tool 4B4 in the second receiver 5B. Thus, a processing unit detection result of "ON"-"OFF"-"ON"-"ON" is obtained in employing the first processing aspect of FIG. 23A.

In a second processing aspect of FIG. 23B, the second processing tool 4B4 is received in the first receiver 5A with the processing surface 461 facing downward, and the first processing tool 4A4 is received in the second receiver 5B with the perforating blade 4113 facing upward. In other words, the projections 521 are fit in the sliding groove 4641 of the second processing tool 4B4 in the first receiver 5A, and the projections 581 are fit in the sliding groove 4121 of the first processing tool 4A4 in the second receiver 5B. Thus, a processing unit detection result of "ON"-"ON"-"OFF"-"ON" is obtained in employing the second processing aspect of FIG. 23B.

Figure 23C:
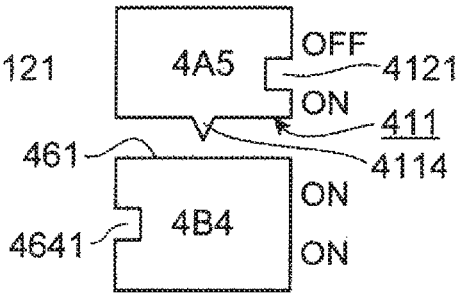
Figure 23C:
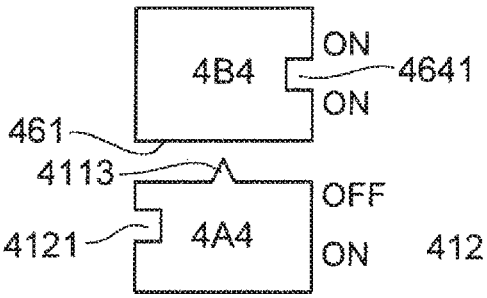
Figure 23C:
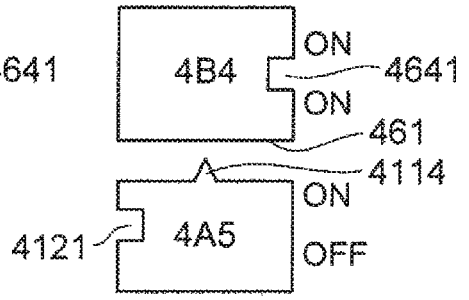

In a third processing aspect of FIG. 23C, the first processing tool 4A5 is received in the first receiver 5A with the micro perforating blade 4114 facing downward, and the second processing tool 4B4 is received in the second receiver 5B with the processing surface 461 facing upward. In other words, the projections 521 are fit in the sliding groove 4121 of the first processing tool 4A5 in the first receiver 5A, and the projections 581 are fit in the sliding groove 4641 of the second processing tool 4B4 in the second receiver 5B. Thus, a processing unit detection result of "OFF"-"ON"-"ON"-"ON" is obtained in employing the third processing aspect of FIG. 23C.

In a fourth processing aspect of FIG. 23D, the second processing tool 4B4 is received in the first receiver 5A with the processing surface 461 facing downward, and the first processing tool 4A5 is received in the second receiver 5B with the micro perforating blade 4114 facing upward. In other words, the projections 521 are fit in the sliding groove 4641 of the second processing tool 4B4 in the first receiver 5A, and the projections 581 are fit in the sliding groove 4121 of the first processing tool 4A5 in the second receiver 5B. Thus, a processing unit detection result of "ON"-"ON"-"ON"-"OFF" is obtained in employing the fourth processing aspect of FIG. 23D.

(Modification 7)

As illustrated in FIGS. 24A to 24F, two types of first processing tools 4A4 and 4A6 and two types of second processing tools 4B6 and 4B7 are used. The first processing tool 4A6 has a creasing convex blade 4111 on a processing surface 411, has a sliding groove 4121 in the center in the vertical direction on a back surface, and has a sliding groove 4141 on a front surface. The sliding groove 4141 is disposed in a position higher than the center (in a position shifted toward an upper surface 413). The second processing tool 4B6 has a creasing concave blade 4611 on a processing surface 461 corresponding to an upper surface, has a creasing concave blade 4612 on a processing surface 463 corresponding to a lower surface, has sliding grooves 4621 and 4622 on a back surface, and has sliding grooves 4641 and 4642 on a front surface. The sliding grooves 4621 and 4641 are disposed in the center in the vertical direction, the sliding groove 4622 is disposed in a position lower than the center (a position shifted toward the processing surface 463), and the sliding groove 4642 is disposed in a position higher than the center (a position shifted toward the processing surface 461). The second processing tool 4B7 has a perforating blade rest 4613 on a processing surface 461 corresponding to an upper surface, and has a sliding groove 4623 in a position lower than the center (a position shifted toward the lower surface 463) on a back surface. The second receptor 5B has projections 582 to be fit in a sliding groove of a processing tool in positions lower than the center on a back surface in the same manner as the projections 521 of the first receiver 5A.

Figures 24A, 24B, 24C, 24D, 24E, 24F:
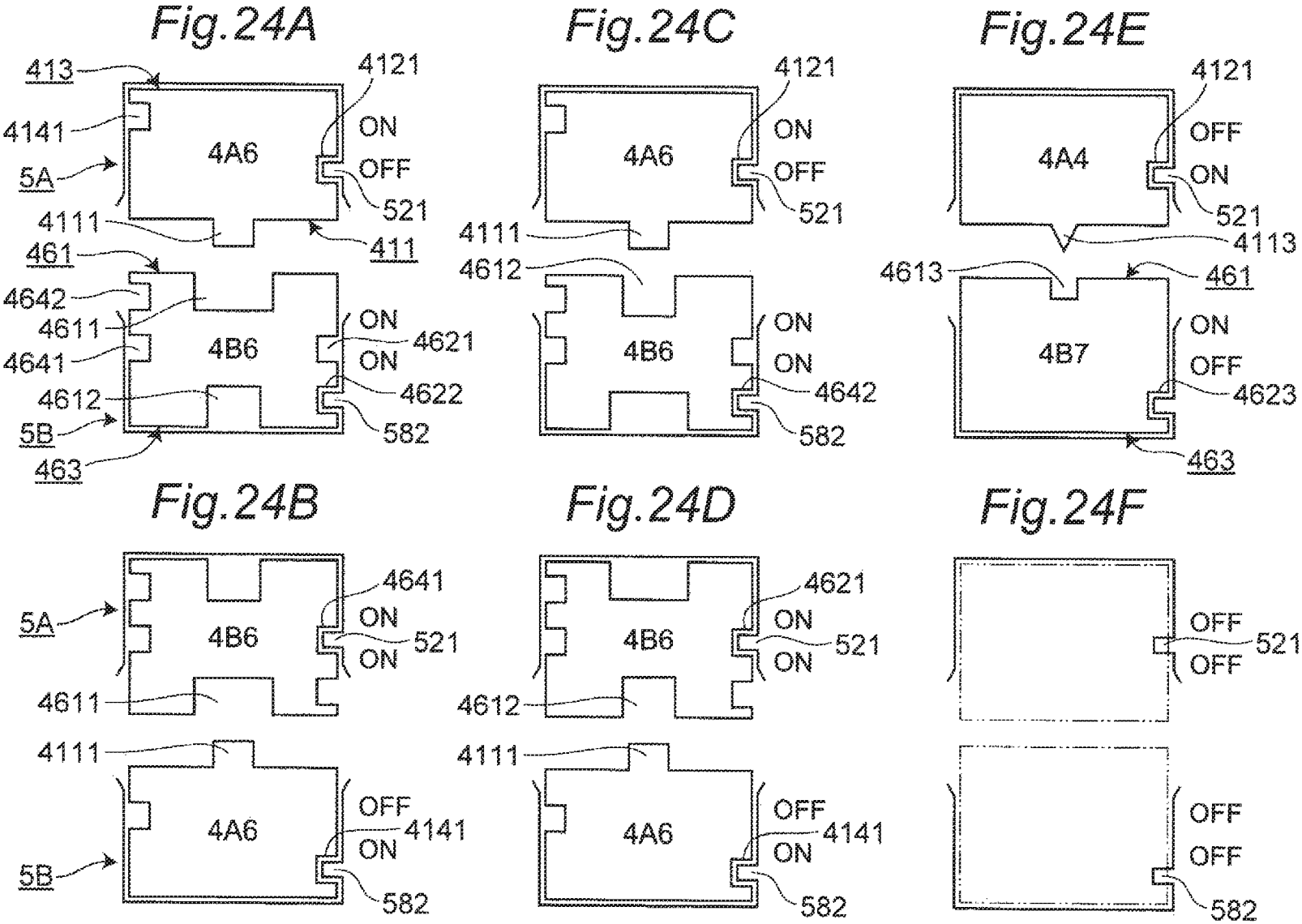
FIGS. 24A to 24F are schematic transverse cross-sectional views illustrating processing aspects of a processing unit according to Modification 7.

In a first processing aspect of FIG. 24A, the first processing tool 4A6 is received in the first receiver 5A with the convex blade 4111 facing downward, and the second processing tool 4B6 is received in the second receiver 5B with the concave blade 4611 facing upward. In other words, the projections 521 are fit in the sliding groove 4121 of the first processing tool 4A6 in the first receiver 5A, and the projections 582 are fit in the sliding groove 4622 of the second processing tool 4B6 in the second receiver 5B. Thus, a processing unit detection result (a first aspect detection result) of "ON"-"OFF"-"ON"-"ON" is obtained in employing the first processing aspect of FIG. 24A.

In a second processing aspect of FIG. 24B, the second processing tool 4B6 is received in the first receiver 5A with the concave blade 4611 facing downward, and the first processing tool 4A6 is received in the second receiver 5B with the convex blade 4111 facing upward. In other words, the projections 521 are fit in the sliding groove 4641 of the second processing tool 4B6 in the first receiver 5A, and the projections 582 are fit in the sliding groove 4141 of the first processing tool 4A6 in the second receiver 5B. Thus, a processing unit detection result (a second aspect detection result) of "ON"-"ON"-"OFF"-"ON" is obtained in employing the second processing aspect of FIG. 24B.

In a third processing aspect of FIG. 24C, the first processing tool 4A6 is received in the first receiver 5A with the convex blade 4111 facing downward, and the second processing tool 4B6 is received in the second receiver 5B with the concave blade 4612 facing upward. In other words, the projections 521 are fit in the sliding groove 4121 of the first processing tool 4A6 in the first receiver 5A, and the projections 582 are fit in the sliding groove 4642 of the second processing tool 4B6 in the second receiver 5B. Thus, a processing unit detection result (a third aspect detection result) of "ON"-"OFF"-"ON"-"ON" is obtained in employing the third processing aspect of FIG. 24C.

In a fourth processing aspect of FIG. 24D, the second processing tool 4B6 is received in the first receiver 5A with the concave blade 4612 facing downward, and the first processing tool 4A5 is received in the second receiver 5B with the convex blade 4111 facing upward. In other words, the projections 521 are fit in the sliding groove 4621 of the second processing tool 4B6 in the first receiver 5A, and the projections 582 are fit in the sliding groove 4141 of the first processing tool 4A6 in the second receiver 5B. Thus, a processing unit detection result (a fourth aspect detection result) of "ON"-"ON"-"OFF"-"ON" is obtained in employing the fourth processing aspect of FIG. 24D.

In a fifth processing aspect of FIG. 24E, the first processing tool 4A4 is received in the first receiver 5A with the perforating blade 4113 facing downward, and the second processing tool 4B7 is received in the second receiver 5B with the recess 4613 facing upward. In other words, the projections 521 are fit in the sliding groove 4121 of the first processing tool 4A4 in the first receiver 5A, and the projections 582 are fit in the sliding groove 4623 of the second processing tool 4B7 in the second receiver 5B. Thus, a processing unit detection result (a fifth aspect detection result) of "OFF"-"ON"-"ON"-"OFF" is obtained in employing the fifth processing aspect of FIG. 24E.

Incidentally, a sixth processing aspect of FIG. 24F corresponds to a state where no processing tool is used, and a processing unit detection result of "OFF"-"OFF"-"OFF"-"OFF" is obtained.

The processability determination section 81 is configured to make a determination of "processable" when the processing unit detection result obtained by the processing unit detection mechanism 7 is the first, second, third, fourth or fifth aspect detection result, and make a determination of "unprocessable" when it is none of the first, second, third, fourth and fifth aspect detection results.

It is noted, in this modification, that the first processing aspect and the third processing aspect are different from each other merely in the width of the creasing concave blade, and hence the same processing unit detection result is obtained in these aspects. Incidentally, a difference in the width of a concave blade causes a difference in sharpness of the outline of a creased portion. Specifically, when the concave blade has a small width, the resultant outline is sharp, and when the concave blade has a large width, the resultant outline is dull. A user may arbitrarily select either of the widths. The same applies to the second processing aspect and the fourth processing aspect.

(Modification 8)

As illustrated in FIGS. 25A to 25D, two types of first processing tools 4A1 and 4A4 and two types of second processing tools 4B1 and 4B4 are used. It is noted that the first processing tool and the second processing tool are integrated with each other.

Figure 26A:
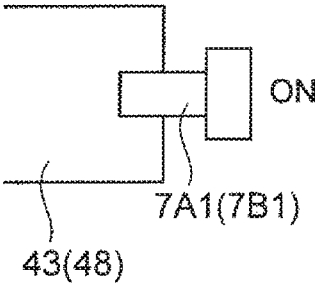
FIGS. 26A and 26B are diagrams illustrating a second example of the detection result obtained by the sensors of the processing unit detection mechanism.
Figure 26B:
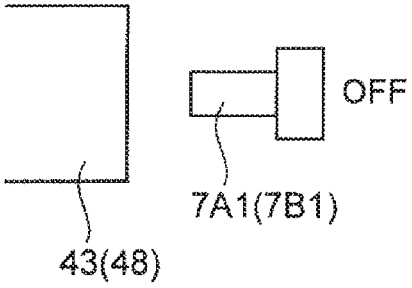

Besides, the processing unit detection mechanism 7 has merely one pair of sensors 7A1 (or 7A2) and merely one pair of sensors 7B1 (or 7B2). The sensor 7A1 (or 7A2) is configured to be able to obtain, from the identification section, detection results as illustrated in FIGS. 26A and 26B. Specifically, two types of detection results of "ON" of FIG. 26A and "OFF" of FIG. 26B are obtained. The same applies to the sensor 7B1 (or 7B2).

Figure 25A:
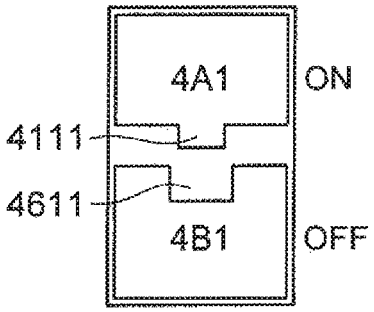
FIGS. 25A to 25D are schematic transverse cross-sectional views illustrating processing aspects of a processing unit according to Modification 8.

In a first processing aspect of FIG. 25A, the first processing tool 4A1 and the second processing tool 4B1 are integrated with each other with the convex blade 4111 facing downward and with the concave blade 4611 facing upward. Thus, a processing unit detection result of "ON"-"OFF" is obtained in employing the first processing aspect of FIG. 25A.

Figure 25C:
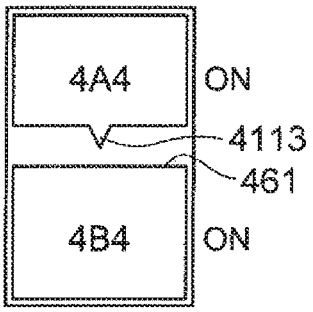
Figure 25B:
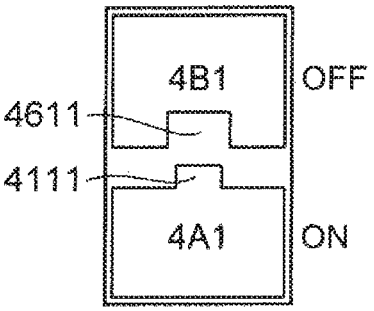

In a second processing aspect; of FIG. 25B, the second processing tool 4B1 and the first processing tool 4A1 are integrated with each other with the concave blade 4611 facing downward and with the convex blade 4111 facing upward. Thus, a processing unit detection result of "OFF"-"ON" is obtained in employing the second processing aspect of FIG. 25B.

In a third processing aspect of FIG. 25C, the first processing tool 4A4 and the second processing tool 4B4 are integrated with each other with the perforating blade 4113 facing downward and with the processing surface 461 facing upward. Thus, a processing unit detection result of "ON"-"ON" is obtained in employing the third processing aspect of FIG. 25C.

Figure 25D:
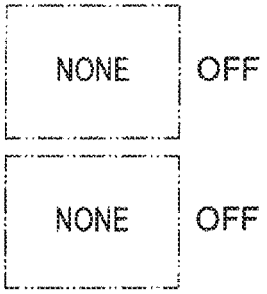

Incidentally, a fourth processing aspect of FIG. 25D corresponds to a stare where no processing tool is used, and a processing unit detection result of "OFF"-"OFF" is obtained.

(Modification 9)

As illustrated in FIGS. 27A to 27G, three types of first processing tools 4A4, 4A6 and 4A7 and two types of second processing tools 4B6 and 4B8 are used. The first processing tool 4A7 is different from the first processing tool 4A6 merely in that a creasing convex blade 4112 thereof has a smaller width than the creasing convex blade 4111. The second processing tool 4B8 has a perforating blade rest 4613 in the shape of a recess on a processing surface 461 corresponding to an upper surface, has a plane perforating blade rest of a processing surface 463 corresponding to a lower surface, has a sliding groove 4623 in a position lower than the center (a position shifted toward the processing surface 463) on a back surface, and has a sliding groove 4643 in a position higher than the center (a position shifted toward the processing surface 461) on a front surface. Besides, the first receiver 5A and the second receiver 5B are respectively the same as those of Modification 7.

Figure 28A:
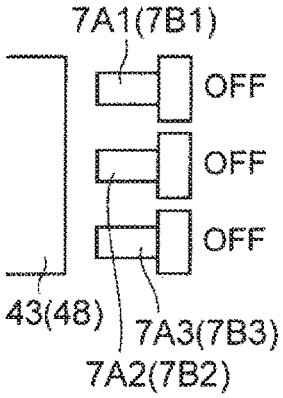
FIGS. 28A to 28H are diagrams illustrating a third example of the detection result obtained by the sensors of the processing unit detection mechanism.
Figure 28B:
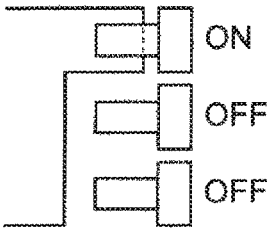
Figure 28C:
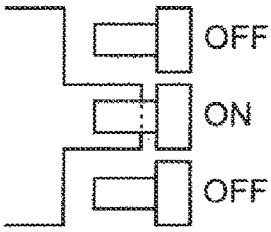
Figure 28D:
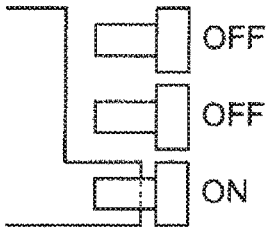
Figure 28E:
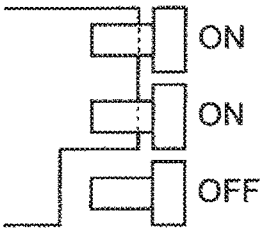
Figure 28F:
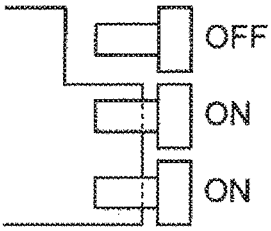
Figure 28G:
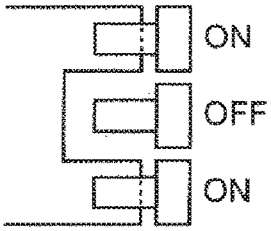
Figure 28H:
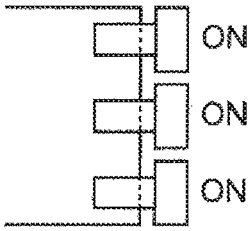

In addition, in the processing unit detection mechanism 7, the first receiver sensor 7A includes three pairs of sensors 7A1, 7A2 and 7A3, the second receiver sensor 7B also includes three pairs of sensors 7B1, 7B2 and 7B3. The first receiver sensor 7A is configured to obtain, from the identification section, detection results as illustrated in FIGS. 28A to 23H. Specifically, eight types of detection results of "OFF"-"OFF"-"OFF" of FIG. 28A, "ON"-"OFF"-"OFF" of FIG. 28B, "OFF"-"ON"-"OFF" of FIG. 28C, "OFF"-"OFF"-"ON" of FIG. 28D, "ON"-"ON"-"OFF" of FIG. 28E, "OFF"-"ON"-"ON" of FIG. 28F, "ON"-"OFF"-"ON" of FIG. 28G and "ON"-"ON"-"ON" of FIG. 28H are obtained. The second receiver sensor 7B is configured in the same manner.

Figure 27A:
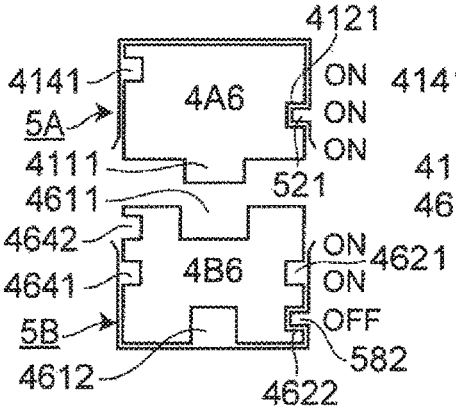
FIGS. 27A to 27G are transverse cross-sectional views illustrating processing aspects of a processing unit and a receiving unit of Modification 9.

In a first processing aspect of FIG. 27A, the first processing tool 4A6 is received in the first receiver 5A with the convex blade 4111 facing downward, and the second processing tool 4B6 is received in the second receiver 5B with the concave blade 4611 facing upward. In other words, the projections 521 are fit in the sliding groove 4121 of the first processing tool 4A6 in the first receiver 5A, and the projections 582 are fit in the sliding groove 4622 of the second processing tool 4B6 in the second receiver 5B. Thus, a processing unit detection result (a first aspect detection result) of "ON"-"ON"-"ON"-"ON"-"ON"-"OFF" is obtained in employing the first processing aspect of FIG. 27A.

Figure 27C:
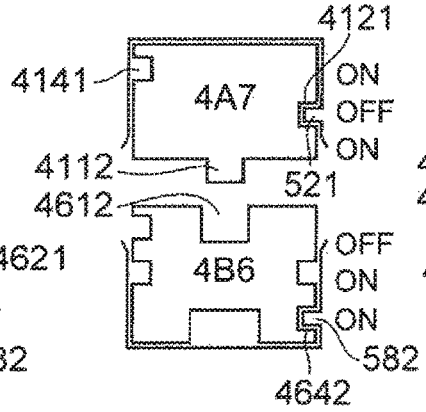
Figure 27E:
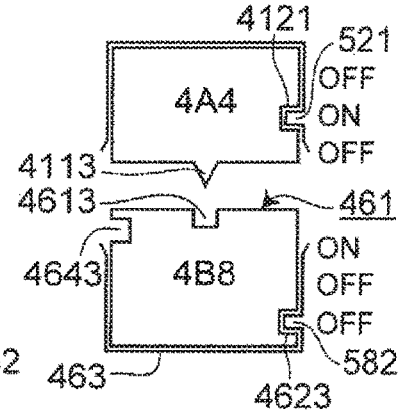
Figure 27B:
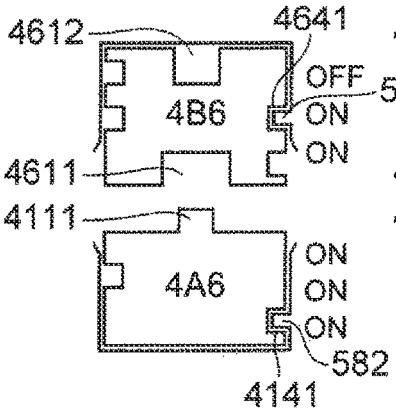

In a second processing aspect of FIG. 27B, the second processing tool 4B6 is received in the first receiver 5A with the concave blade 4611 facing downward, and the first processing tool 4A6 is received in the second receiver 5B with the convex blade 4111 facing upward. In other words, the projections 521 are fit in the sliding groove 4641 of the second processing tool 4B6 in the first receiver 5A, and the projections 582 are fit in the sliding groove 4141 of the first processing tool 4A6 in the second receiver 5B. Thus, a processing unit detection result (a second aspect detection result) of "OFF"-"ON"-"ON"-"ON"-"ON"-"ON" is obtained in employing the second processing aspect of FIG. 27B.

In a third processing aspect of FIG. 27C, the first processing tool 4A7 is received in the first receiver 5A with the convex blade 4112 facing downward, and the second processing tool 4B6 is received in the second receiver 5B with the concave blade 4612 facing upward. In other words, the projections 521 are fit in the sliding groove 4121 of the first processing tool 4A7 in the first receiver 5A, and the projections 582 are fit in the sliding groove 4642 of the second processing tool 4B6 in the second receiver 5B. Thus, a processing unit detection result (a third aspect detection result) of "ON"-"OFF"-"ON"-"OFF"-"ON"-"ON" is obtained in employing the third processing aspect of FIG. 27C.

Figure 27D:
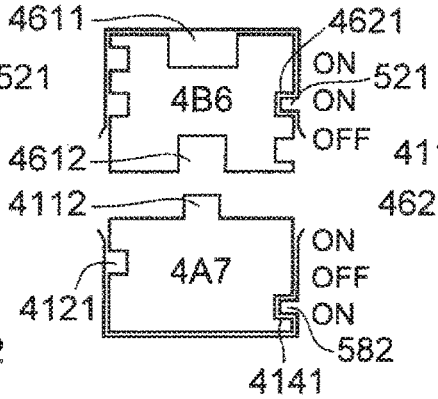

In a fourth processing aspect of FIG. 27D, the second processing tool 4B6 is received in the first receiver 5A with the concave blade 4612 facing downward, and the first processing tool 4A7 is received in the second receiver 5B with the convex blade 4112 facing upward. In other words, the projections 521 are fit in the sliding groove 4621 of the second processing tool 4B6 in the first receiver 5A, and the projections 582 are fit in the sliding groove 4141 of the first processing tool 4A7 in the second receiver 5B. Thus, a processing unit detection, result (a fourth aspect detection result) of "ON"-"ON"-"OFF"-"ON"-"OFF"-"ON" is obtained in employing the fourth processing aspect of FIG. 27D.

In a fifth processing aspect of FIG. 27E, the first processing tool 4A4 is received in the first receiver 5A with the perforating blade 4113 facing downward, and the second processing tool 4B8 is received in the second receiver 5B with the recess 4613 facing upward. In other words, the projections 521 are fit in the sliding groove 4121 of the first: processing tool 4A4 In the first receiver 5A, and the projections 582 are fit in the sliding groove 4623 of the second processing tool 4B8 in the second receiver 5B. Thus, a processing unit detection result (a fifth aspect detection result) of "OFF"-"ON"-"OFF"-"ON"-"OFF"-"OFF" is obtained in employing the fifth processing aspect of FIG. 27E.

Figure 27F:
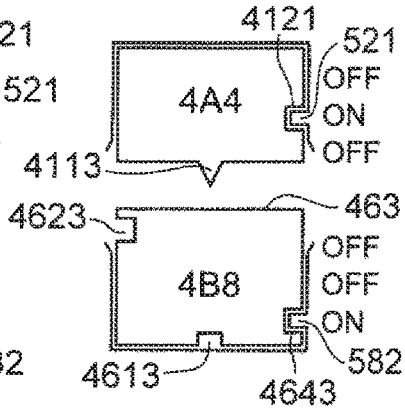

In a sixth processing aspect of FIG. 27F, the first processing tool 4A4 is received in the first receiver 5A with the perforating blade 4113 facing downward, and the second processing tool 4B8 is received in the second receiver 5B with the processing surface 463 facing upward. In other words, the projections 521 are fit in the sliding groove 4121 of the first processing tool 4A4 in the first receiver 5A, and the projections 582 are fit in the sliding groove 4643 of the second processing tool 4B8 in the second receiver 5B. Thus, a processing unit detection result (a sixth aspect detection result) of "OFF"-"ON"-"OFF"-"OFF"-"OFF"-"ON" is obtained in employing the sixth processing aspect of FIG. 27F.

Figure 27G:
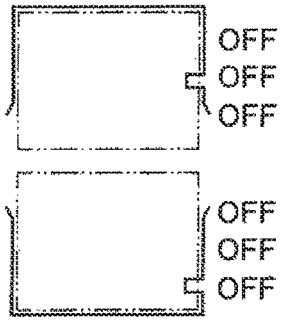

Incidentally, a seventh processing aspect of FIG. 27G corresponds to a state where no processing tool is used, and a processing unit detection result of "OFF"-"OFF"-"OFF"-"OFF"-"OFF"-"OFF" is obtained.

The processability determination section 81 is configured to make a determination of "processable" when the processing unit detection result obtained by the processing unit detection mechanism 7 is the first, second, third, fourth, fifth or sixth aspect detection result, and make a determination of "unprocessable" when it is none of the first, second, third, fourth, fifth and sixth aspect detection results.

(Modification 10)

Figure 29:
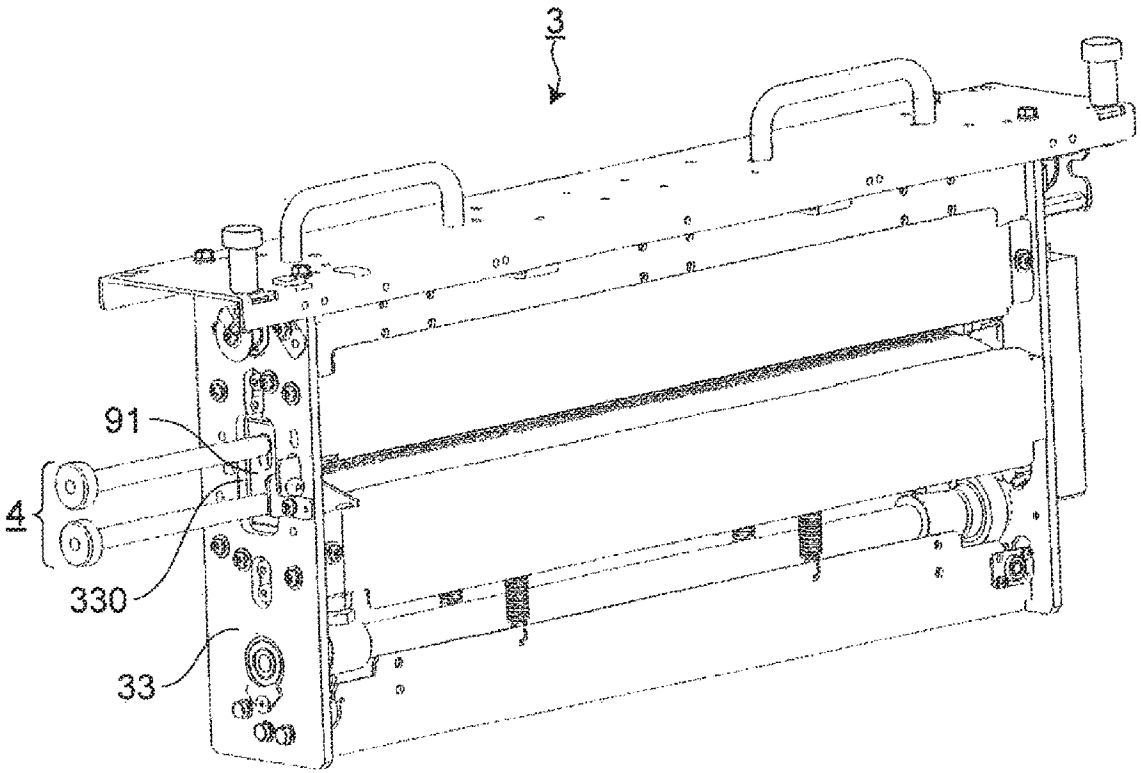
FIG. 29 is a perspective view of a sheet processor according to Modification 10.
Figure 30:
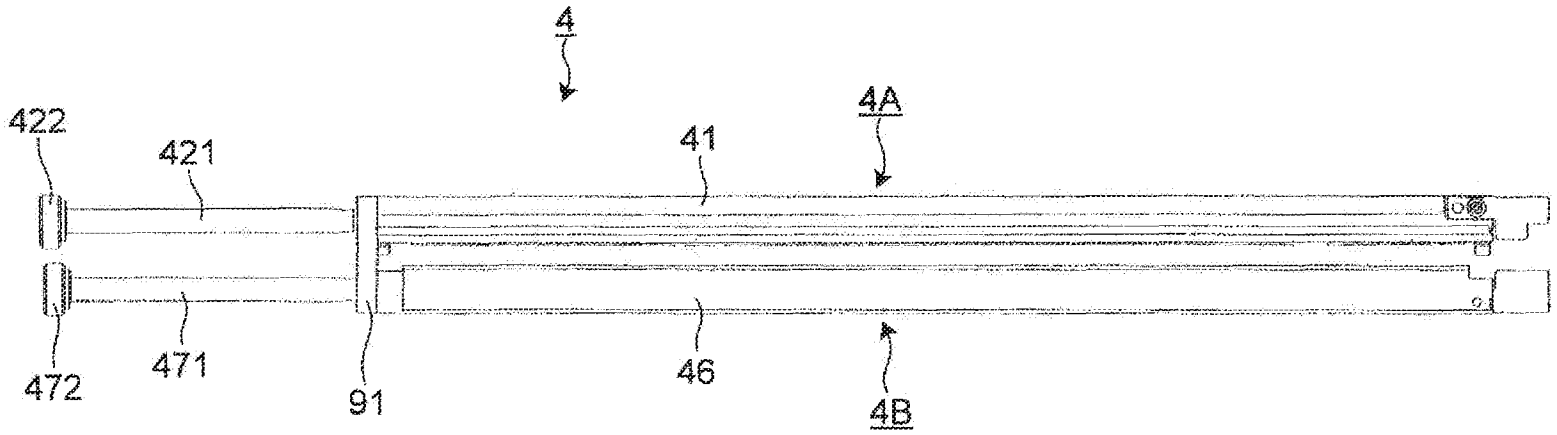
FIG. 30 is a diagram illustrating a processing unit used in Modification 10.

In the sheet processor 3 of FIG. 29, the processing unit 4 is configured to be integrally attachable/detachable. Specifically, the first processing body 41 of the first processing tool 4A and the second processing body 46 of the second processing tool 4B are integrated with each other by connection in at least base portions in the longitudinal direction through a connecting member 91, so that the integrated processing unit can be taken in/out through an opening 330 formed on the left side plate 33. The processing unit 4 thus integrated can be taken out through the opening 330, then vertically turned over, and attached on the receiving unit 5 through the opening 330. Besides, when the holds 421 and 471 are removed respectively from the first and second processing bodies 41 and 46, the connection through the connecting member 91 between the first processing body 41 and the second processing body 46 can be released. Then, the processing bodies can be easily exchanged with another type of processing bodies. For example, a processing body for the crease processing can be easily exchanged with a processing body for the perforation processing.

When this structure is employed, an operation for attaching/detaching the processing unit 4 and an operation for vertically turning over the processing unit 4 can be easily performed. Besides, the type of the processing to be performed by the processing unit 4 can be easily changed.

(Modification 11)

Figure 31:
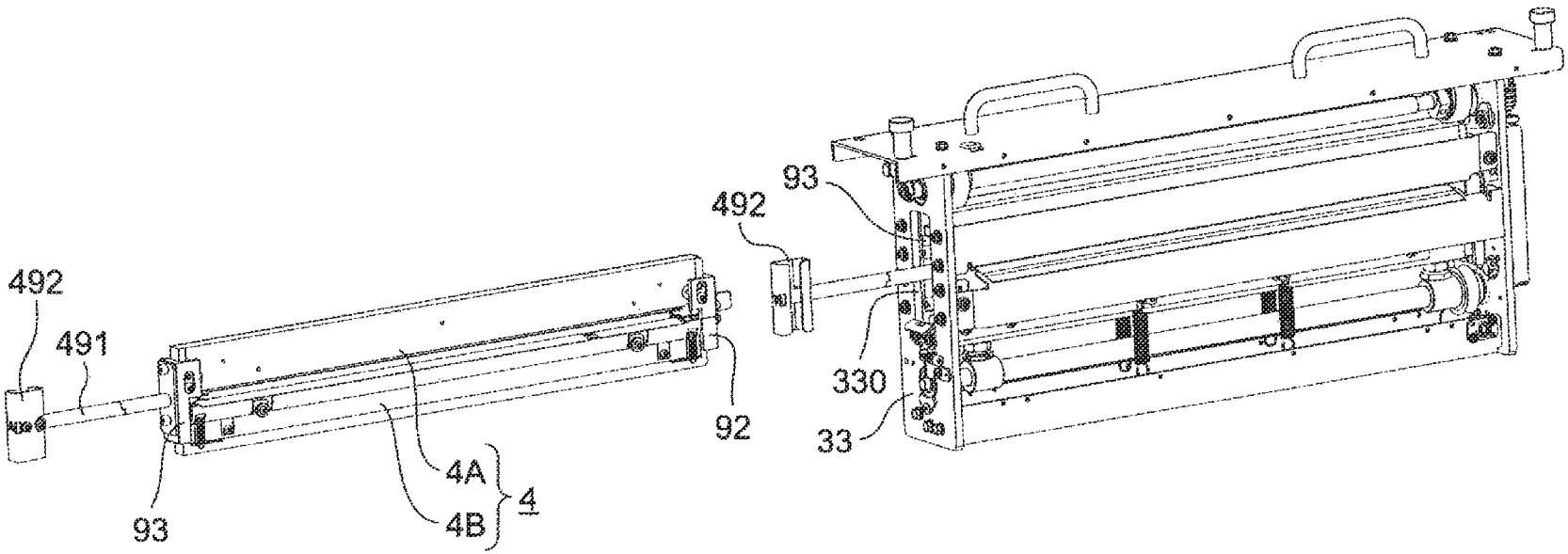
FIG. 31 is a perspective view illustrating an attaching/detaching operation performed in a sheet processor of Modification 11.

In the sheet processor 3 of FIG. 31, the processing unit 4 is configured to be integrally attachable/detachable. Specifically, the first processing tool 4A and the second processing tool 4B are integrated with each other by connection through a connecting member 92 provided in a tip portion along the longitudinal direction and a connecting member 93 provided in a base portion along the longitudinal direction, so that the integrated processing unit can be taken in/out through the opening 330 formed on the left side plate 33 by grasping one hold 491 and one handle 492. The processing unit 4 thus integrated is taken out through the opening 330, vertically turned over, and attached on the outer frame 30 (FIG. 2) through the opening 330. Besides, the processing unit can be easily exchanged with another type of processing unit 4. For example, a processing unit for the crease processing can be easily exchanged with a processing unit for perforation processing.

When this structure is employed, the operation for attaching/detaching the processing unit 4 and the operation for vertically turning over the processing unit 4 can be easily performed. Besides, the type of the processing to be performed by the processing unit 4 can be easily changed. Incidentally, processing aspects can be set as illustrated in FIGS. 25A to 25D.

(Modification 12)

Figure 32:
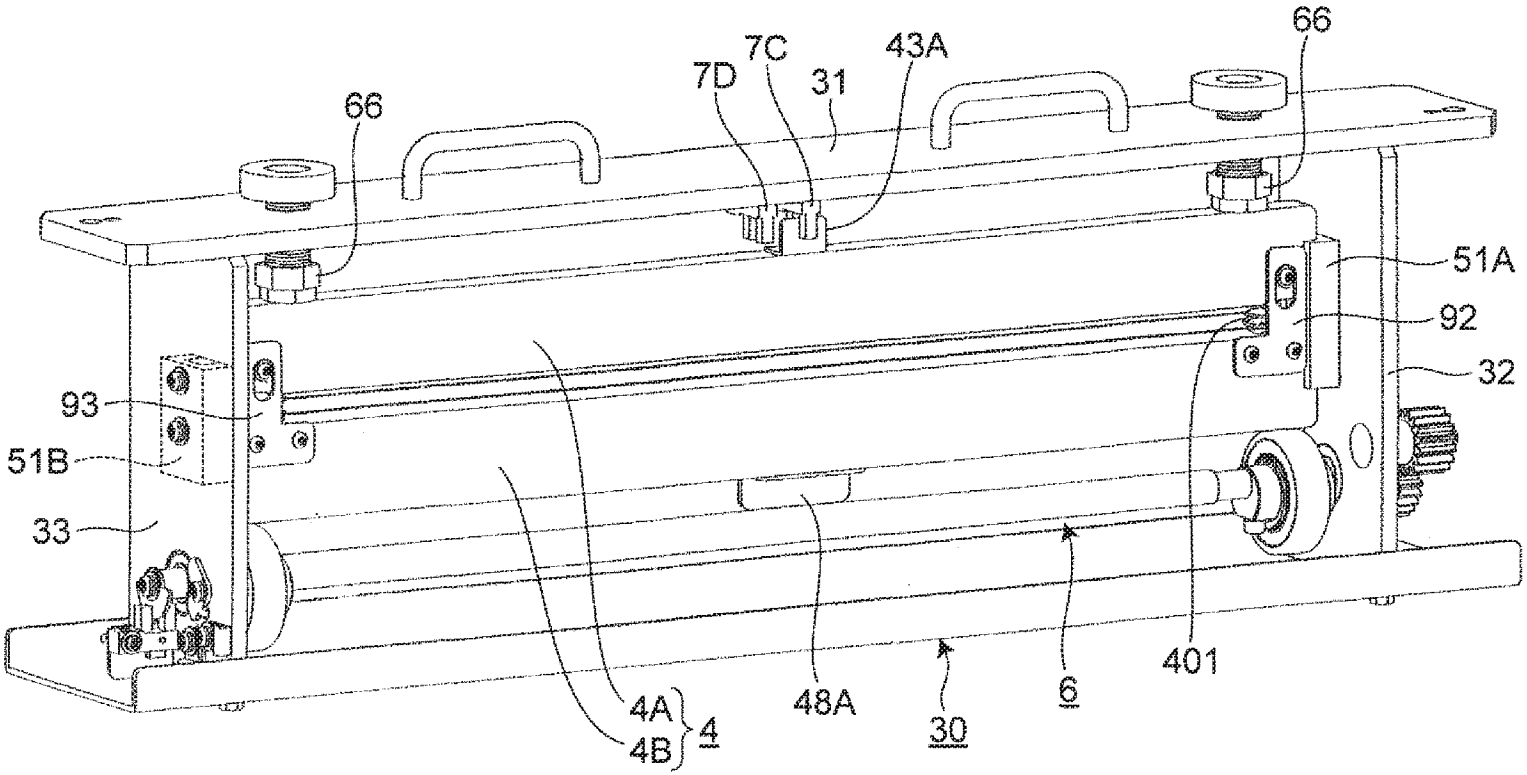
FIG. 32 is a perspective view of a sheet processor according to Modification 12.
Figure 33:
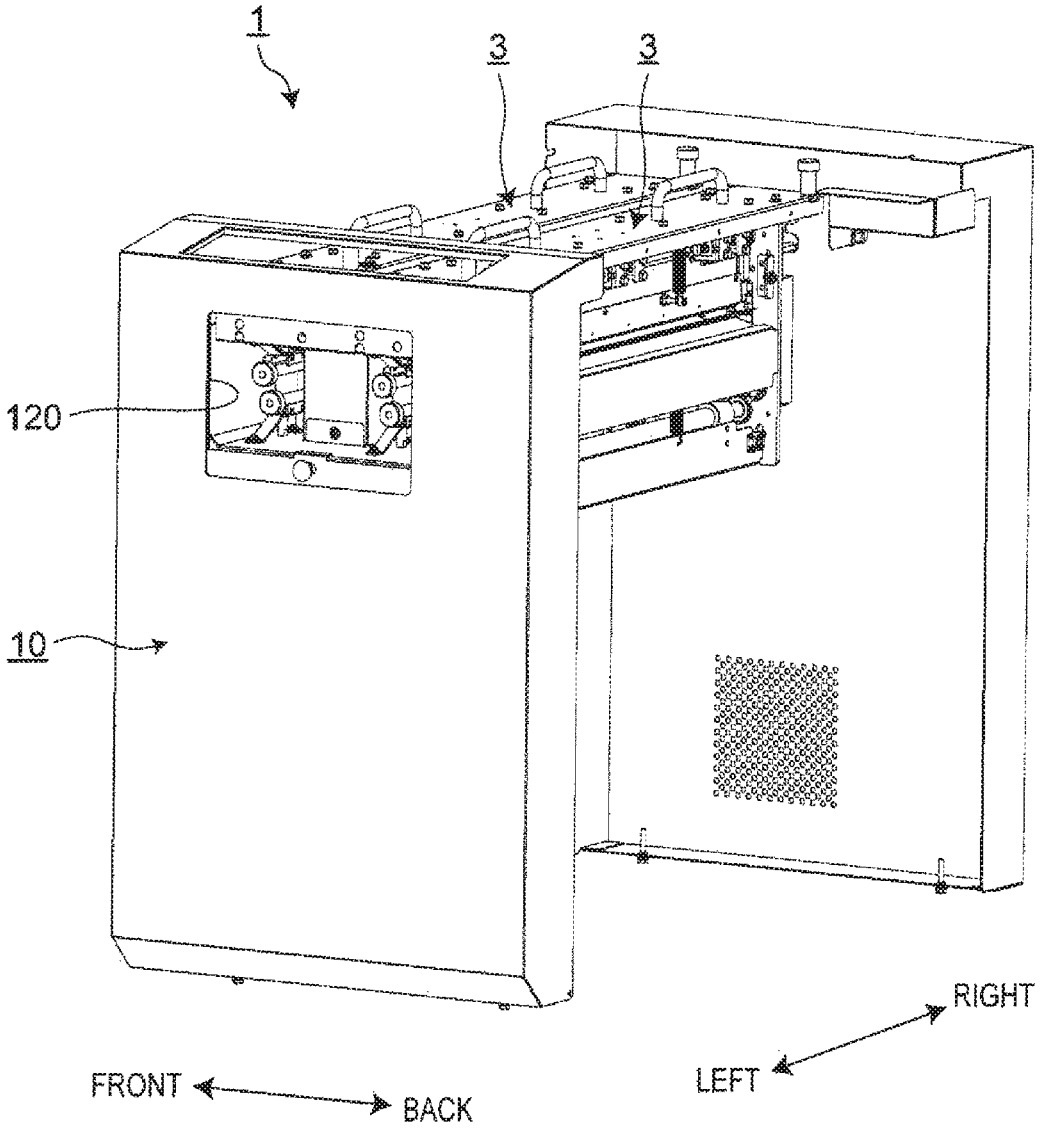
FIG. 33 is a left side perspective view of a sheet processing apparatus according to Modification 13.
Figure 34:
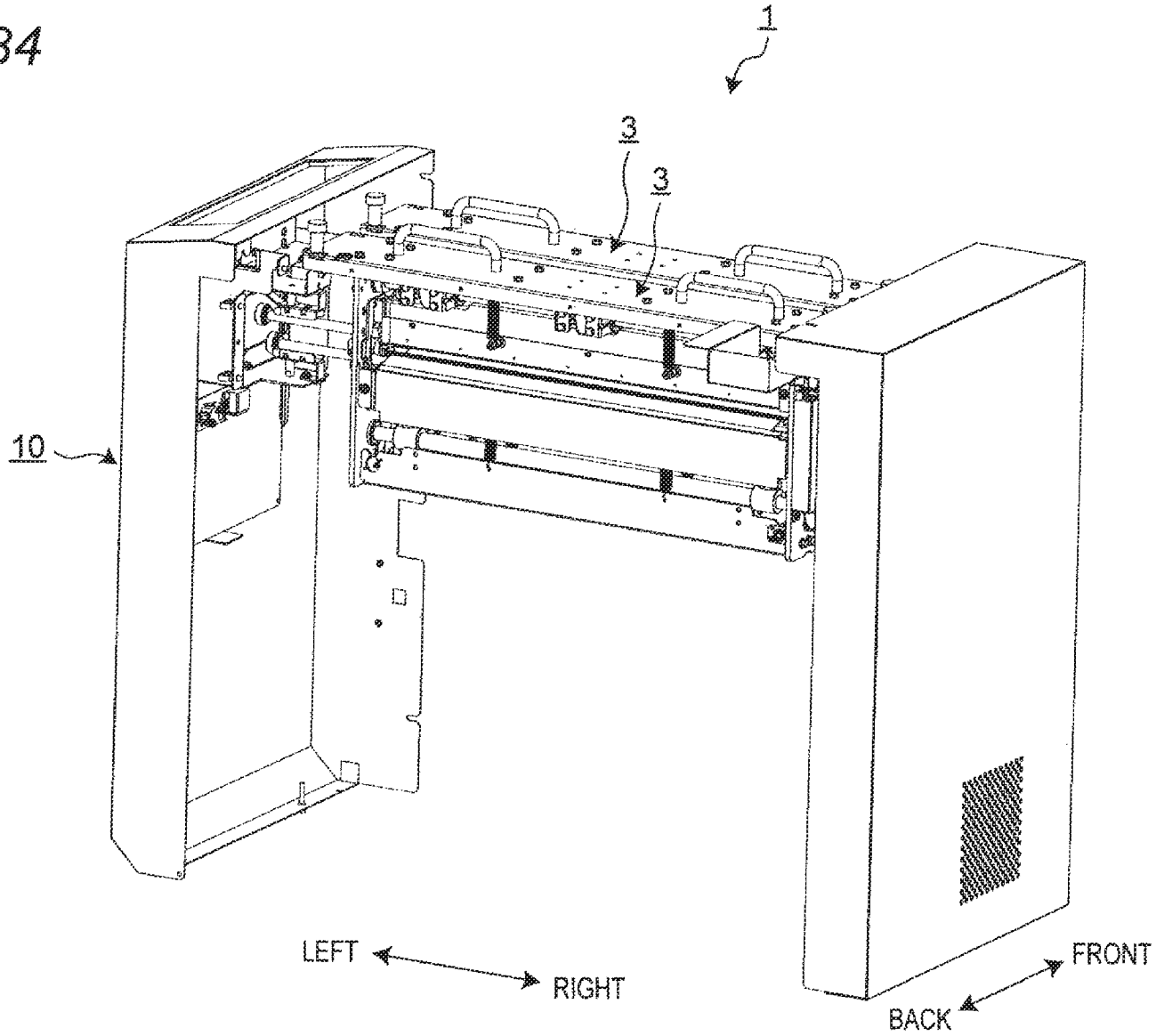
FIG. 34 is a right side perspective view of the sheet processing apparatus according to Modification 13.

In the sheet processor 3 of FIG. 32, the processing unit 4 is configured to be integrally attachable/detachable. Specifically, a first receiver 51A is fixed on the right side plate 32, and a second receiver 51B is fixed on the left side plate 33. In addition, the first processing tool 4A and the second processing tool 4B are vertically slidably supported by the first receiver 51A at tip portions thereof in the longitudinal direction and by the second receiver 51B at base portions thereof in the longitudinal direction, so that the processing unit can be attached within the outer frame 30. The first processing tool 4A and the second processing tool 4B are integrated with each other by connection through the connecting member 92 disposed in the tip portions in the longitudinal direction and the connecting member 93 disposed in the base portions in the longitudinal direction, so that the processing tools can be taken in/out the outer frame 30 upward with the top plate 31 removed. Besides, the outer frame 30 is fixed on the main body 10, and the top plate 31 is removably fixed on the main body 10 with the finger screw 36 not illustrated in FIG. 32. The processing unit 4 thus integrated can be taken out the outer frame 30 in the upward direction, then vertically turned over, and attached from the above in the outer frame 30.

A spring 401 is provided between the first processing tool 4A and the second processing tool 4B, so as to always bias the first processing tool 4A and the second processing tool 4B in directions away from each other. The pressing mechanism 6 is disposed below the second processing tool 4B. Besides, an adjustment dial 66 in contact with the first receiver 51A from above is provided on the top plate 31, and the first processing tool 4A is adjusted in the height position by the adjustment dial 66. Furthermore, sensors 7C and 7D are provided on a back surface of the top plate 31. When the first processing tool 4A is disposed on an upper side, the sensors 7C and 7D detect a detection plate 43A provided on the first processing tool 4A to obtain a detection result of "ON"-"OFF", and when the second processing tool 4B is disposed on the upper side, the sensors detect a detection plate 48A provided on the second processing tool 4B to obtain a detection result of "ON"-"ON".

When this structure is employed, the operation for attaching/detaching the processing unit 4 and the operation for vertically turning over the processing unit 4 can be easily performed.

(Modification 13)

Figure 35:
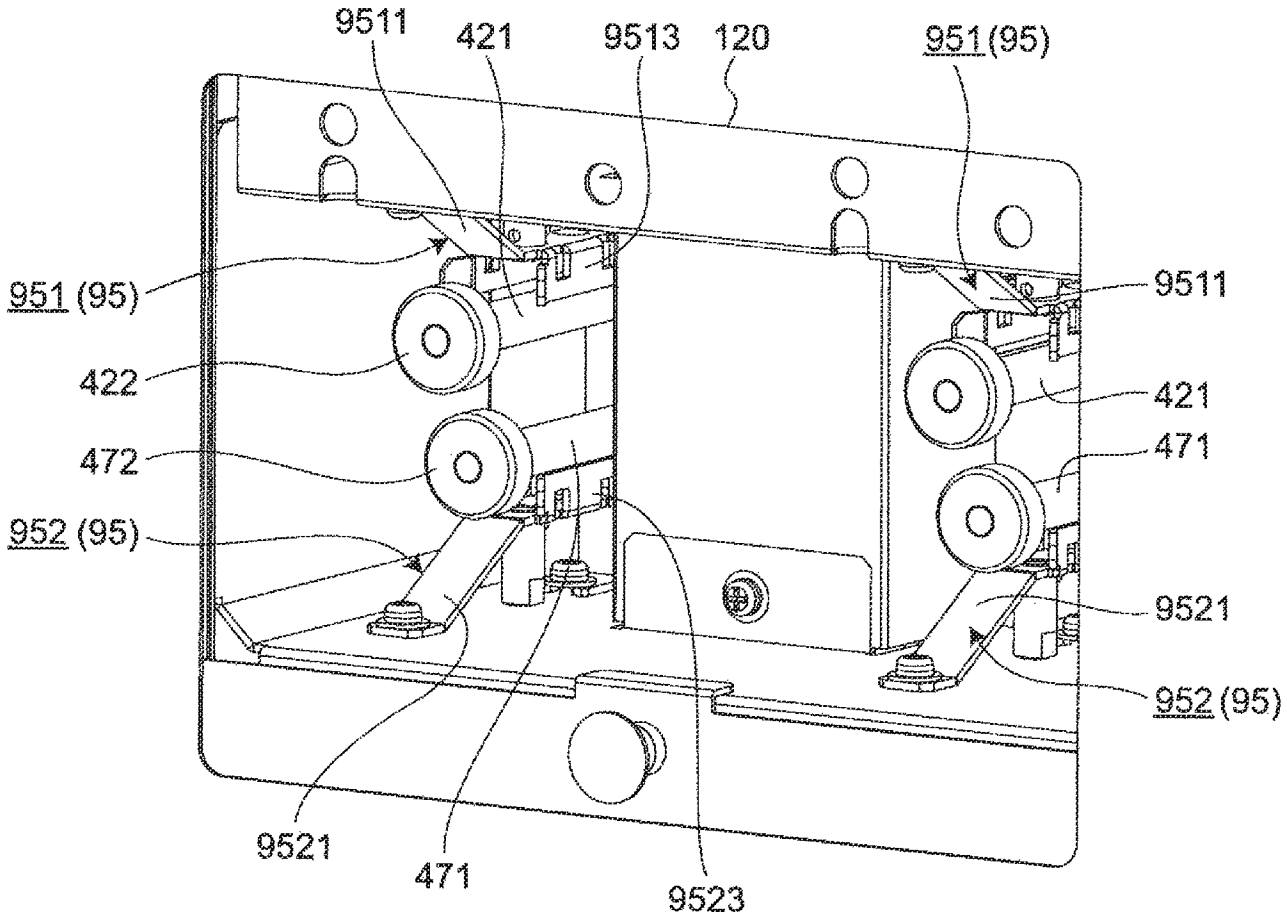
FIG. 35 is an enlarged view of a main part of FIG. 33.
Figure 36:
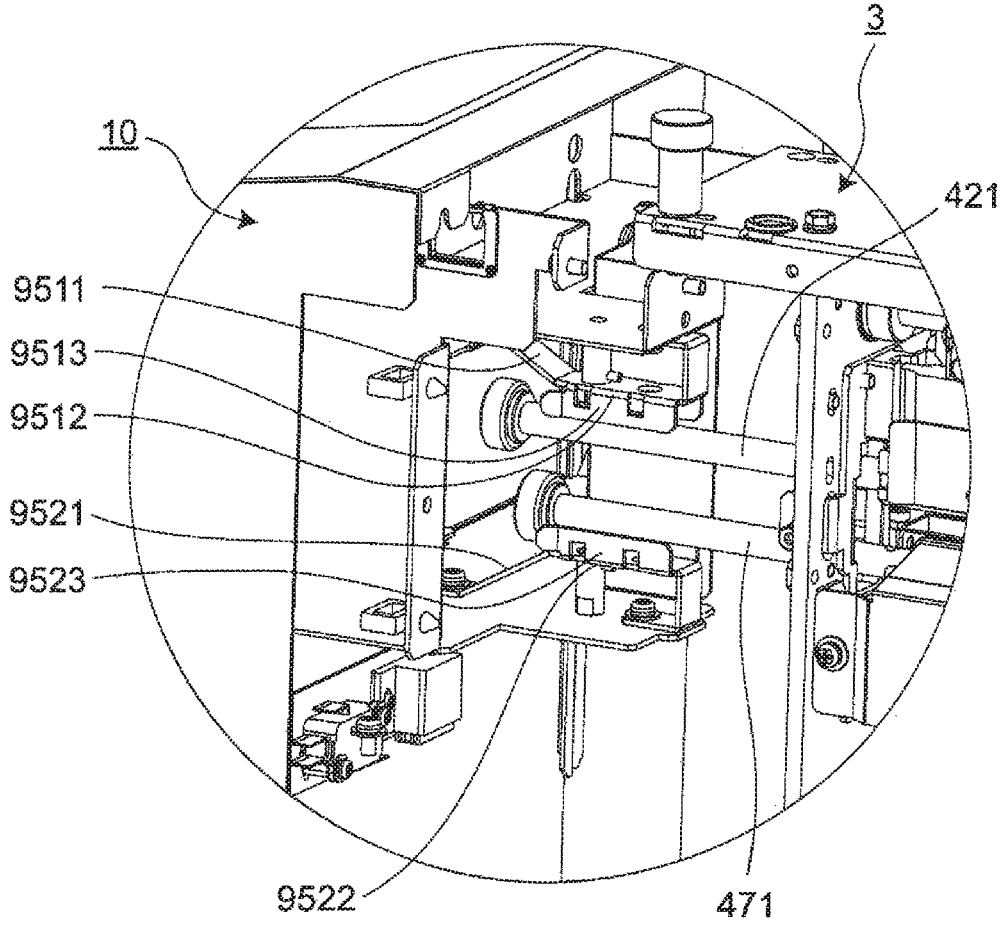
FIG. 36 is an enlarged view of a main part of FIG. 34.

FIGS. 33 to 36 illustrate the sheet processing apparatus 1 including an attachment assisting member for assisting an operation for attaching the processing unit 4 on the receiving unit 5. Here, as illustrated in a left perspective view of FIG. 33 and a right perspective view of FIG. 34, two sheet processors 3 are fixed on the main body 10. FIG. 35 is an enlarged diagram of a main part of FIG. 33. FIG. 36 is an enlarged diagram of a main part of FIG. 34. The main body 10 has an opening 120 through which the processing unit 4 is taken in/out, and includes the attachment assisting member 95 within the opening 120.

The attachment assisting member 95 includes an upper plate member 951 for sliding and orienting the processing body toward the first receiver 5A in attaching the processing tool on the first receiver 5A, and a lower plate member 952 for sliding and orienting the processing body toward the second receiver 5B in attaching the processing tool on the second receiver 5B.

The upper plate member 951 includes a tapered portion 9511 and a horizontal portion 9512 extending along the widthwise direction W and toward the first receiver 5A. The tapered portion 9511 is inclined in the downward direction. The horizontal portion 9512 has a descending plate 9513 formed for restricting the processing body from deviating from the widthwise direction W.

The lower plate member 952 includes a tapered portion 9521 and a horizontal portion 9522 extending along the widthwise direction W and toward the second receiver 5B. The tapered portion 9521 is inclined in the upward direction. The horizontal portion 9522 has an ascending plate 9523 formed for restricting the processing body from deviating from the widthwise direction W.

When this structure is employed, the processing tool can be easily attached on the first receiver 5A and the second receiver 5B.

It is noted that the attachment assisting member 95 may be provided correspondingly merely to the first receiver 5A or the second receiver 5B.

Besides, the attachment assisting member 95 may be provided in the sheet processor 3 instead of the main body 10. In this case, the attachment assisting member 95 is provided, for example, outside the left side plate 33.

(Modification 14)

Although a processing tool having a processing surface not only on the upper surface but also on the lower surface is used in some cases in each of the above-described embodiment and modifications, a processing tool having a processing surface also on a side surface in addition to the upper surface and/or the lower surface may be used. In this case, the processing tool is attached on the receiving unit with the side surface having the processing surface facing upward or downward by upward/downward and/or frontward/backward rotative displacement. The processing tool to be used in this case has substantially the same dimensions not only in the vertical direction but also in the lateral direction, namely, is in a shape having a square cross section. Thus, when the processing tool is rotatively displaced frontward/backward in the receiver, the front surface or the back surface can be caused to face downward for performing the processing.

For example, when one processing tool has a plane perforating blade rest on all of the upper surface, the lower surface and the both side surfaces, a perforating blade rest having abraded through contact with a perforating blade of another processing tool can be easily changed to another perforating blade rest not abraded by the rotative displacement of the processing tool.

(Modification 15)

The receiving unit 5 includes the first receiver 5A or the second receiver 5B alone.

(Modification 16)

The projections to be fit in the sliding groove of the processing tool are provided not intermittently as described above but continuously in the longitudinal direction.

(Modification 17)

Three types or more of the first processing tools 4A and/or the second processing tools 4B are prepared.

(Modification 18)

The first processing tool 4A and/or the second processing tool 4B is in a shape having a polygonal cross section, such as a shape having a regular hexagonal cross section or having a regular octagonal cross section, has a processing surface on an arbitrarily large number of surfaces, and is configured to be received in the receiver to have an arbitrary processing surface facing downward by the rotative displacement.

(Modification 19)

Figure 37:
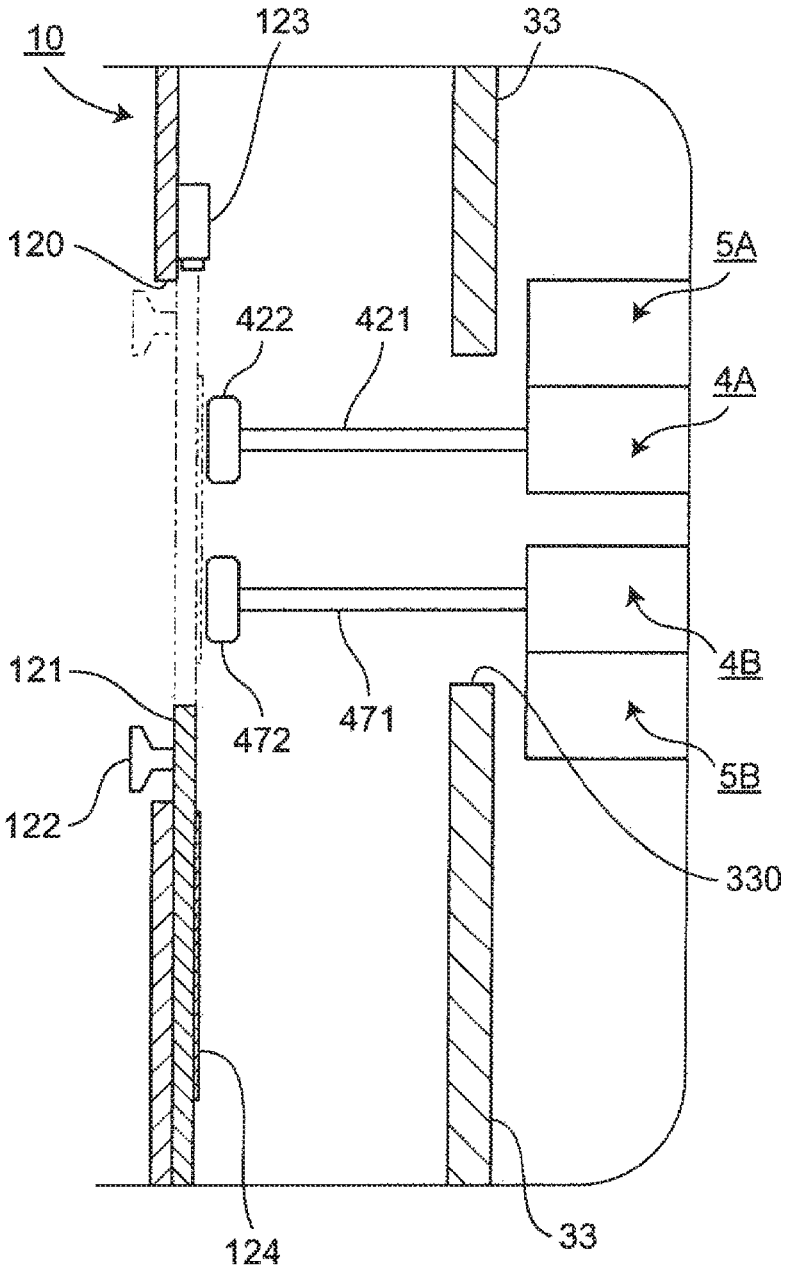
FIG. 37 is a partial vertical cross-sectional view of a sheet processing apparatus according to Modification 19.

As illustrated in FIG. 37, the main body 10 includes a shutter 121 for opening/closing the opening 120. The shutter 121 is configured to be manually opened/closed with a knob 122 gripped. The main body 10 includes a switch 123 pressed when the shutter 121 is closed, and the sheet processor 3 is configured to be allowed to operate merely when the switch 123 is pressed. A resin thin plate 124 is adhered onto an inner surface of the shutter 121.

According to this modification, the following advantageous effects can be exhibited:

(a) The processing tools 4A and 4B are prevented by the shutter 121 from coming off from the receivers during the operation of the sheet processor 3.

(b) Even when the processing tools 4A and 4B slightly come off from the receivers to cause the handles 422 and 472 of the processing tools 4A and 4B to interfere with the shutter 121, the handles 422 and 472 merely rub against the resin thin plate 124, and hence the vertical movement of the processing tools 4A and 4B in the sheet processor 3 is not affected.

(c) Since the sheet processor 3 is operated merely when the shutter 121 is closed owing to the switch 123, the sheet processor 3 can be prevented from operating with the shutter 121 opened, and thus, safety of an operator can be ensured.

INDUSTRIAL APPLICABILITY

According to a sheet processor of the present invention, processing can be performed also on a back surface of a sheet without turning over the sheet, and thus, the present invention has high industrial applicability.

DESCRIPTION OF REFERENCE NUMERALS

3 sheet processor
4 processing unit
4A first processing tool
4B second processing tool
5 receiving unit
5A first receiver
5B second receiver
7 processing unit detection mechanism
7A first receiver sensor
7B second receiver sensor
95 attachment assisting member
100 sheet

What is claimed is:

1. A sheet processor subjecting a sheet having been conveyed forward to processing along a direction perpendicular to a conveyance direction of the sheet, comprising:

a processing unit performing the processing; and a receiving unit receiving the processing unit therein in a state capable of performing the processing on the sheet, wherein the processing unit includes a first processing tool and a second processing tool disposed to vertically oppose each other with a conveyance surface of the sheet disposed therebetween, and the receiving unit includes at least one receiver that removably receives the first processing tool and the second processing tool in the state capable of performing the processing on the sheet, with arbitrarily selected one of the first processing tool and the second processing tool disposed above the conveyance surface, and with arbitrarily selected another of the first processing tool and the second processing tool disposed below the conveyance surface, wherein the receiving unit includes a first receiver and a second receiver disposed to vertically oppose each other, and wherein the first receiver, the second receiver, the first processing tool, and the second processing tool are configured such that:

the first receiver selectively receives therein at least one of the first processing tool and the second processing tool, wherein each of the first processing tool and the second processing tool can be selectively received therein in an upward orientation and in a downward orientation, or the second receiver selectively receives therein at least another of the first processing tool and the second processing tool, wherein each of the first processing tool and the second processing tool can be selectively received therein in an upward orientation and in a downward orientation.

2. The sheet processor according to claim 1, wherein each of the first processing tool and the second processing tool is removable from a corresponding one of the first receiver and the second receiver by a sliding mechanism.

3. The sheet processor according to claim 1, wherein the first processing tool is a male processing tool and the second processing tool is a female processing tool, and the receiving unit includes a processing unit detection mechanism detecting which of the male processing tool and the female processing tool has been received in each of the first receiver and the second receiver.

4. The sheet processor according to claim 3, wherein the processing unit detection mechanism further detects a type of processing to be performed by each of the first processing tool and the second processing tool having been received in the receiving unit.

5. The sheet processor according to claim 4, wherein each of the first processing tool and the second processing tool includes, in an end portion thereof, an identification section corresponding to a type of processing to be performed by the corresponding one of the processing tool, the processing unit detection mechanism includes:

a first receiver sensor detecting the identification section of one of the first processing tool and the second processing tool having been received in the first receiver; and a second receiver sensor detecting the identification section of another of the first processing tool and the second processing tool having been received in the second receiver, and the processing unit detection mechanism is configured to obtain a processing unit detection result corresponding to a combination of a first detection result of the first receiver sensor and a second detection result of the second receiver sensor.

6. The sheet processor according to claim 3, wherein each of the first processing tool and the second processing tool includes, in an end portion thereof, an identification section corresponding to a type of processing to be performed by the corresponding one of the processing tool, the processing unit detection mechanism includes:

a first receiver sensor detecting the identification section of one of the first processing tool and the second processing tool having been received in the first receiver; and a second receiver sensor detecting the identification section of another of the first processing tool and the second processing tool having been received in the second receiver, and the processing unit detection mechanism is configured to obtain a processing unit detection result corresponding to a combination of a first detection result of the first receiver sensor and a second detection result of the second receiver sensor.

7. The sheet processor according to claim 6, further comprising:

a processing control section controlling the processing unit, wherein the processing control section is configured to control a processing operation based on the processing unit detection result obtained by the processing unit detection mechanism.

8. The sheet processor according to claim 3, further comprising:

a processability determination section determining processability based on the processing unit detection result obtained by the processing unit detection mechanism.

9. The sheet processor according to claim 1, wherein the first processing tool is a male processing tool, and has, in an end portion thereof, an interfering member having a length protruding beyond the conveyance surface of the sheet.

10. The sheet processor according to claim 1, wherein:

the first receiver selectively receives therein at least one of the first processing tool and the second processing tool in an upward orientation or in a downward orientation, and the second receiver selectively receives therein at least another of the first processing tool and the second processing tool in an upward orientation or in a downward orientation.

11. A sheet processor subjecting a sheet having been conveyed forward to processing along a direction perpendicular to a conveyance direction of the sheet, comprising:

a processing unit performing the processing; and a receiving unit receiving the processing unit therein in a state capable of performing the processing on the sheet, wherein the processing unit includes a first processing tool and a second processing tool disposed to vertically oppose each other with a conveyance surface of the sheet disposed therebetween, and wherein the receiving unit includes a first receiver and a second receiver disposed to vertically oppose each other, the receiving unit is configured to removably receive the first processing tool and the second processing tool in the state capable of performing the processing on the sheet, with arbitrarily selected one of the first processing tool and the second processing tool disposed above the conveyance surface, and with arbitrarily selected another of the first processing tool and the second processing tool disposed below the conveyance surface, the first receiver receives, in receiving the first processing tool therein, the first processing tool in only one of an upward orientation and a downward orientation, and in receiving the second processing tool therein, the second processing tool can be selectively received therein in an upward orientation and in a downward orientation, and the second receiver receives, in receiving the second processing tool therein, the second processing tool in only one of an upward orientation and a downward orientation, and in receiving the first processing tool therein, the first processing tool can be selectively received therein in an upward orientation and in a downward orientation.

12. The sheet processor according to claim 11, wherein each of the first processing tool and the second processing tool is removable from a corresponding one of the first receiver and the second receiver by a sliding mechanism.

13. A sheet processor subjecting a sheet having been conveyed forward to processing along a direction perpendicular to a conveyance direction of the sheet, comprising:

a processing unit performing the processing; and a receiving unit receiving the processing unit therein in a state capable of performing the processing on the sheet, wherein the processing unit includes a first processing tool and a second processing tool disposed to vertically oppose each other with a conveyance surface of the sheet disposed therebetween, and the receiving unit includes at least one receiver that removably receives the first processing tool and the second processing tool in the state capable of performing the processing on the sheet, with arbitrarily selected one of the first processing tool and the second processing tool disposed above the conveyance surface, and with arbitrarily selected another of the first processing tool and the second processing tool disposed below the conveyance surface, wherein each of the first processing tool and the second processing tool is removable from a corresponding one of the first receiver and the second receiver by a sliding mechanism, wherein the sliding mechanism has longitudinally extending sliding grooves formed on side surfaces of each of the first processing tool and the second processing tool, and longitudinally extending projections formed on side surfaces of each of the first receiver and the second receiver, and each of the first processing tool and the second processing tool is received in each of the first receiver and the second receiver with the sliding grooves slid against the projections.

14. A sheet processor subjecting a sheet having been conveyed forward to processing along a direction perpendicular to a conveyance direction of the sheet, comprising:

a processing unit performing the processing; and a receiving unit receiving the processing unit therein in a state capable of performing the processing on the sheet, wherein the processing unit includes a first processing tool and a second processing tool disposed to vertically oppose each other with a conveyance surface of the sheet disposed therebetween, and the receiving unit includes at least one receiver that removably receives the first processing tool and the second processing tool in the state capable of performing the processing on the sheet, with an arbitrarily selected one of the first processing tool and the second processing tool disposed above the conveyance surface, and with an arbitrarily selected another of the first processing tool and the second processing tool disposed below the conveyance surface, wherein the processing unit includes a connecting member integrally removably connecting the first processing tool and the second processing tool to the receiving unit, and wherein the processing unit is configured such that the first processing tool and the second processing tool, while integrated by the connecting member, are able to be taken out from the receiving unit in an upward or lateral direction, then vertically turned over, and attached from a top or a side in the receiving unit.

15. A sheet processing apparatus, comprising:

the sheet processor according to claim 1, wherein the processing is performed on the sheet by the sheet processor during conveyance of the sheet.

16. The sheet processing apparatus according to claim 15, wherein the sheet processor is removably provided on a main body.

17. The sheet processing apparatus according to claim 16, wherein the sheet processor or the main body includes an attachment assisting member that assists attachment of at least one of the first processing tool and the second processing tool on the receiving unit.

18. The sheet processing apparatus according to claim 15, wherein the sheet processor or the main body includes an attachment assisting member that assists attachment of at least one of the first processing tool and the second processing tool on the receiving unit.

* * * * *